US010086524B2

(12) United States Patent
Zhang

(10) Patent No.: US 10,086,524 B2
(45) Date of Patent: Oct. 2, 2018

(54) CUTTING TOOL

(71) Applicant: D-CUT PRODUCTS, INC., Oak Brook, IL (US)

(72) Inventor: Charlie Zhang, Oak Brook, IL (US)

(73) Assignee: D-CUT PRODUCTS, INC., Oak Brook, IL (US)

( * ) Notice: Subject to any disclaimer, the term of this patent is extended or adjusted under 35 U.S.C. 154(b) by 111 days.

(21) Appl. No.: 15/142,729

(22) Filed: Apr. 29, 2016

(65) Prior Publication Data

US 2016/0263759 A1 Sep. 15, 2016

Related U.S. Application Data

(63) Continuation-in-part of application No. 15/013,349, filed on Feb. 2, 2016, which is a continuation-in-part of application No. 14/613,117, filed on Feb. 3, 2015, which is a continuation-in-part of application No. 13/707,777, filed on Dec. 7, 2012, now Pat. No. 9,180,600.

(51) Int. Cl.

| | |
|---|---|
| ***B26D 1/08*** | (2006.01) |
| ***B26D 5/16*** | (2006.01) |
| ***B26D 1/00*** | (2006.01) |
| ***B26D 5/10*** | (2006.01) |
| ***B26D 7/26*** | (2006.01) |

(52) U.S. Cl.

CPC ..... *B26D 1/085* (2013.01); *B26D 1/0006* (2013.01); *B26D 1/08* (2013.01); *B26D 5/10* (2013.01); *B26D 5/16* (2013.01); *B26D 7/2628* (2013.01); *B26D 2001/004* (2013.01); *Y10T 83/762* (2015.04); *Y10T 83/8749* (2015.04); *Y10T 83/885* (2015.04); *Y10T 83/8843* (2015.04)

(58) Field of Classification Search

CPC ..... B26D 1/085; B26D 1/0006; B26D 1/08; B26D 5/10; B26D 5/16; B26D 7/2628; B26D 5/083

USPC ... 83/522.11, 522.15, 522.16, 522.17, 471.2, 83/471.3, 472, 629

See application file for complete search history.

(56) References Cited

U.S. PATENT DOCUMENTS

| | | | | |
|---|---|---|---|---|
| 2,697,488 A | | 12/1954 | Stempel | |
| 3,151,515 A | | 10/1964 | Suverkrop | |
| 3,580,123 A | | 5/1971 | Westra et al. | |
| 3,678,581 A | | 7/1972 | Bolduc | |
| 3,690,208 A | | 9/1972 | Muller | |
| 3,702,016 A | * | 11/1972 | Keesee ..... | A01D 34/824 16/437 |
| 3,726,164 A | | 4/1973 | Cocquebert | |

(Continued)

FOREIGN PATENT DOCUMENTS

DE 20 2008 002 459 U1 8/2009

*Primary Examiner* — Kenneth E. Peterson
*Assistant Examiner* — Nhat Chieu Do
(74) *Attorney, Agent, or Firm* — Pauley Erickson & Kottis

(57) ABSTRACT

A cutting tool for cutting flexible building materials, such as, for example, rubber or vinyl baseboards, chair rails and crown molding, at an angle. The cutting tool includes a pair of risers moveably connected near a center of a base with a hinge connection. A blade holder and blade positioned between the risers and moveable from a starting position to a cutting position. The blade can be set to a range of angles relative to the base by rotating the risers and locking the risers in an angle relative to the base.

13 Claims, 42 Drawing Sheets

(56) References Cited

U.S. PATENT DOCUMENTS

| | | | | |
|---|---|---|---|---|
| 3,785,233 | A | 1/1974 | Robinson | |
| 4,328,728 | A | 5/1982 | Ferdinand et al. | |
| 4,480,529 | A | 11/1984 | Winkler et al. | |
| 4,503,743 | A * | 3/1985 | Ryba | B23D 53/04 83/801 |
| 4,513,501 | A | 4/1985 | Lee | |
| 4,579,027 | A | 4/1986 | Lewis | |
| 5,255,587 | A | 10/1993 | Eichenberg et al. | |
| 7,204,179 | B1 * | 4/2007 | Meyer | B23D 21/003 83/454 |
| 9,180,600 | B2 | 11/2015 | Zhang | |
| 2004/0089126 | A1 | 5/2004 | McLean et al. | |
| 2009/0301277 | A1 | 12/2009 | Ipatenco et al. | |
| 2010/0263512 | A1 * | 10/2010 | Zhang | B26D 1/08 83/628 |
| 2015/0135924 | A1 | 5/2015 | Zhang | |
| 2015/0143969 | A1 | 5/2015 | Zhang | |
| 2016/0144522 | A1 | 5/2016 | Zhang | |

* cited by examiner

CUTTING TOOL

CROSS REFERENCE TO RELATED APPLICATION

This application is a continuation-in-part of U.S. patent application Ser. No. 15/013,349, filed on 2 Feb. 2016, which is a continuation-in-part of U.S. patent application Ser. No. 14/613,117, filed on 3 Feb. 2015, now abandoned which is a continuation-in-part of U.S. patent application Ser. No. 13/707,777, filed on 7 Dec. 2012, now U.S. Pat. No. 9,180,600. The co-pending parent application is hereby incorporated by reference herein in its entirety and is made a part hereof, including but not limited to those portions which specifically appear hereinafter.

BACKGROUND OF THE INVENTION

Field of the Invention

This invention relates to a cutting tool for cutting sheets of building materials, for example laminate, at a range of angles from vertical and/or horizontal including, but not limited to, angles of 22.5°, 45°, 90°, 135°, and 157.5°. More specifically, this invention relates to a cutting tool including a base, a cutting platform adjustably connected to the base near a center of the base, a cutting platform actuator for adjusting an angle between the cutting platform and the base to allow a blade to cut building materials at a range of angles.

Discussion of Related Art

Often carpenters need to cut building materials, such as baseboards and crown molding, with a beveled or mitered cut in order to fit in or around corners. Various tools are currently used to cut building materials with a beveled cut, however most are bulky, heavy, require power to be operated, produce large amounts of dust during the cutting process, and/or result in uneven or splintered cuts. Accordingly, there is a need for an improved cutting tool for cutting building materials with beveled cut. There is a need for a portable, non-power operated cutting tool capable of cutting building materials with a vertical or beveled cut and in a predictable and straight fashion without splintering, cracking or similar problems and without creating dust.

SUMMARY OF THE INVENTION

The present invention provides a portable, non-power operated cutting tool for cutting sheets of building materials at a range of angles in both a vertical and horizontal direction without splintering or cracking.

According to an embodiment of this invention, the cutting tool includes a base with a cutting platform connected to the base with a pivotable connection for example, but not limited to, a hinge and an axle. The cutting platform preferably includes a pair of supports. The supports are preferably positioned on either side of the cutting platform with a cam connected to at least one of the supports. A blade holder, with a blade, is positioned under the cam and aligned the cutting platform. In a preferred embodiment, a handle is connected to the cam to assist in rotating the cam. The blade holder and the blade are moveable between an open position and a closed position by pivoting the cam. In the open position, the cam contacts the blade holder at a relatively small radius, as the cam rotates, the blade holder contacts the cam at a gradually increasing radius until the blade holder and the blade are in a closed position.

According to a preferred embodiment, as the blade holder travels from the open position to the closed position, the blade holder is maintained in a generally straight path by the supports or a pair of guide pins. A hole in the blade holder is of slightly larger diameter than the support so that the path of travel of the blade holder is maintained straight providing a consistent and repeatable cutting motion. In a preferred embodiment, a spring is positioned between the support and the blade holder. The spring biases the blade holder in the open position and as the blade holder travels downward, the spring is compressed to further urge a uniform cut of the blade through the material.

According to a preferred embodiment of this invention, the base and the cutting platform are connected with a lockable hinge that allows the cutting platform, guide pin, blade holder and cam to be angled relative to the base. With this arrangement, the cutting tool of this invention can cut a building material with a vertical cut or an angled cut, for example a 45° miter cut from vertical. Preferably, the lockable hinge allows the cutting surface to be locked into a range of angles, ranging from 0° to 45°.

According to another preferred embodiment of this invention, the base and the cutting platform are pivotally connected. The cutting tool includes a cutting platform adjuster for varying an angle of the cutting platform relative to the base. With this arrangement, the cutting tool of this invention can cut a building material with a vertical cut or an angled cut, for example a 45° miter cut from vertical. Preferably, the cutting platform adjuster holds the cutting platform at the selected angle, ranging from 0° to 90°. In an embodiment, the cutting platform adjuster preferably comprises a hand crank connected to a bevel gear and a threaded extender, and a connector connected to the cutting platform. Alternatively, the cutting platform may comprise a rack and pinion extender, a scissor extender, or another device for adjusting the angle of the cutting platform. In an embodiment of this invention, the cutting platform adjuster may be operated with an electric motor.

In an embodiment of this invention, the handle is adjustable relative to the cam, allowing for the cutting tool to move through a full range of motion, from the open position to the closed position, for all angled cuts.

According to a preferred embodiment of this invention, the base further includes a guide rail for aligning the building material to the blade. The guide rail is adjustable, allowing the building material to set at a range of angles to the blade in a horizontal plane.

In another embodiment, the cutting tool of this invention is designed to cut flexible materials, including but not limited to rubber or vinyl materials. In this embodiment, the cutting tool includes a base with a pair of risers that can adjustably connected to the base at a plurality of angles. The cutting tool of this embodiment further includes a blade holder and a blade that are moveable, along the pair of risers, from a starting position to a final cutting position. In this embodiment, the blade holder is positionable at a plurality of angular positions. In a preferred embodiment for cutting flexible materials, the blade may be set at a first angle to cut the flexible material at a second angle wherein the first angle is greater than the second angle. For example, the blade and blade holder may be set at an angle of 48° to 52° to cut the flexible material at a 45° angle.

In another embodiment of this invention, the cutting tool of this invention is designed to cut building materials at a range of angles, for example angles ranging from 22.5° to 157.5°. In this embodiment, the cutting tool includes a base with a pair of risers that can adjustably connected near the center of the base to cut a plurality of angles. The cutting tool of this embodiment further includes a blade holder and a blade that are moveable, along the pair of risers, from a starting position to a final cutting position. By positioning the risers, the blade holder and the blade near the center of the base, a user may set the blade at an angle and cut either the selected angle or the complimentary angle while supporting the desired cut piece on the right side or left side of the base and the support surface. In other embodiments with the risers, the blade holder and blade positioned on one side of the base, the complimentary angle could be cut by flipping over the material to be cut. However, when the material to be cut has a non-flat profile, the material may move or rock during the cutting process resulting in an improper cut. Furthermore, cutting the material on its face, rather than back, may damage the face of the material. This embodiment may also be used to cut flexible materials including but not limited to rubber or vinyl materials. In a preferred embodiment for cutting flexible materials, the blade may be set at a first angle to cut the flexible material at a second angle wherein the first angle is greater than the second angle. For example, the blade and blade holder may be set at an angle of 46° to 52° to cut the flexible material at a 45° angle.

DESCRIPTION OF THE INVENTION

Figure 1:
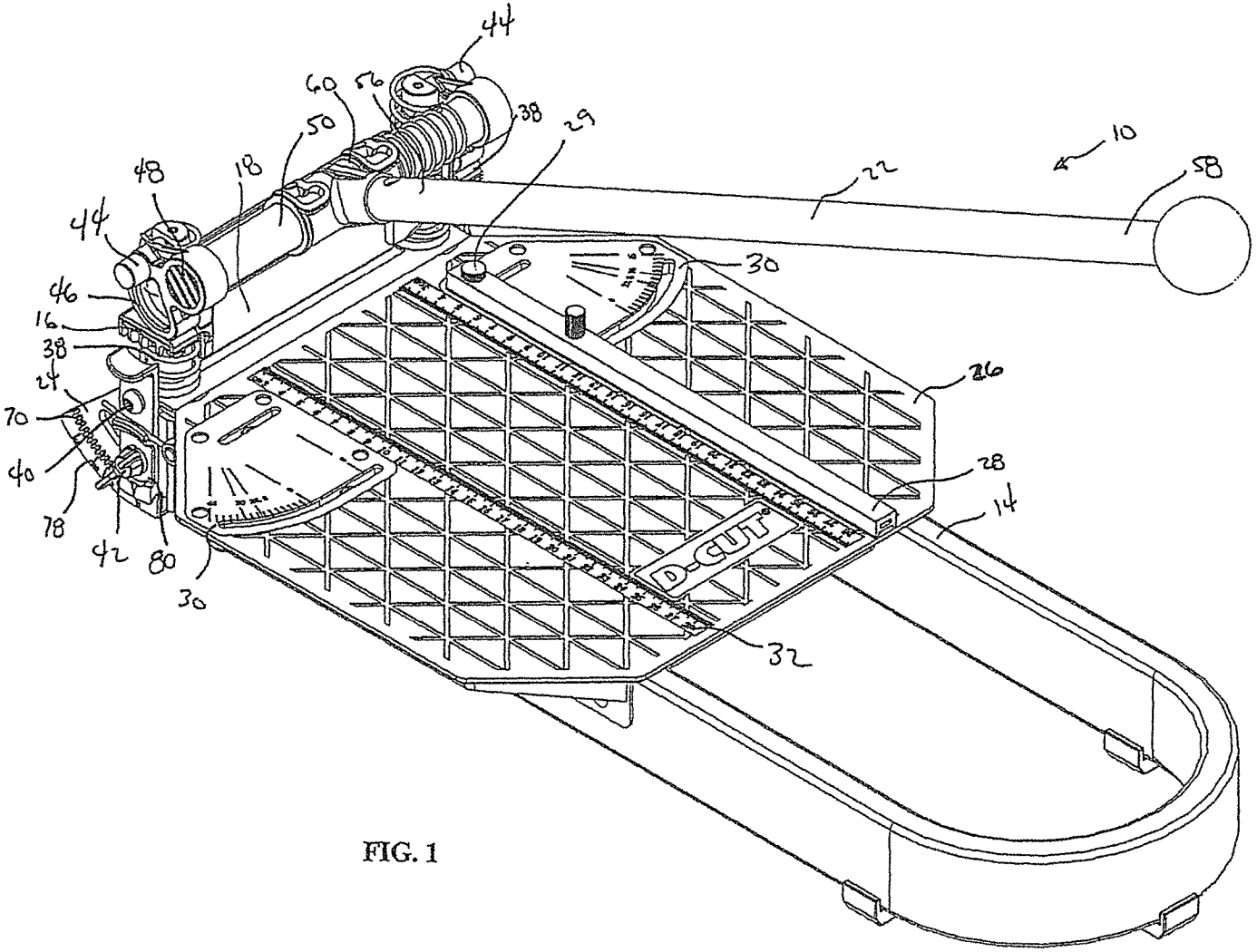
FIG. 1 is a perspective view of a cutting tool in a closed position according to one embodiment of this invention.
Figure 2:
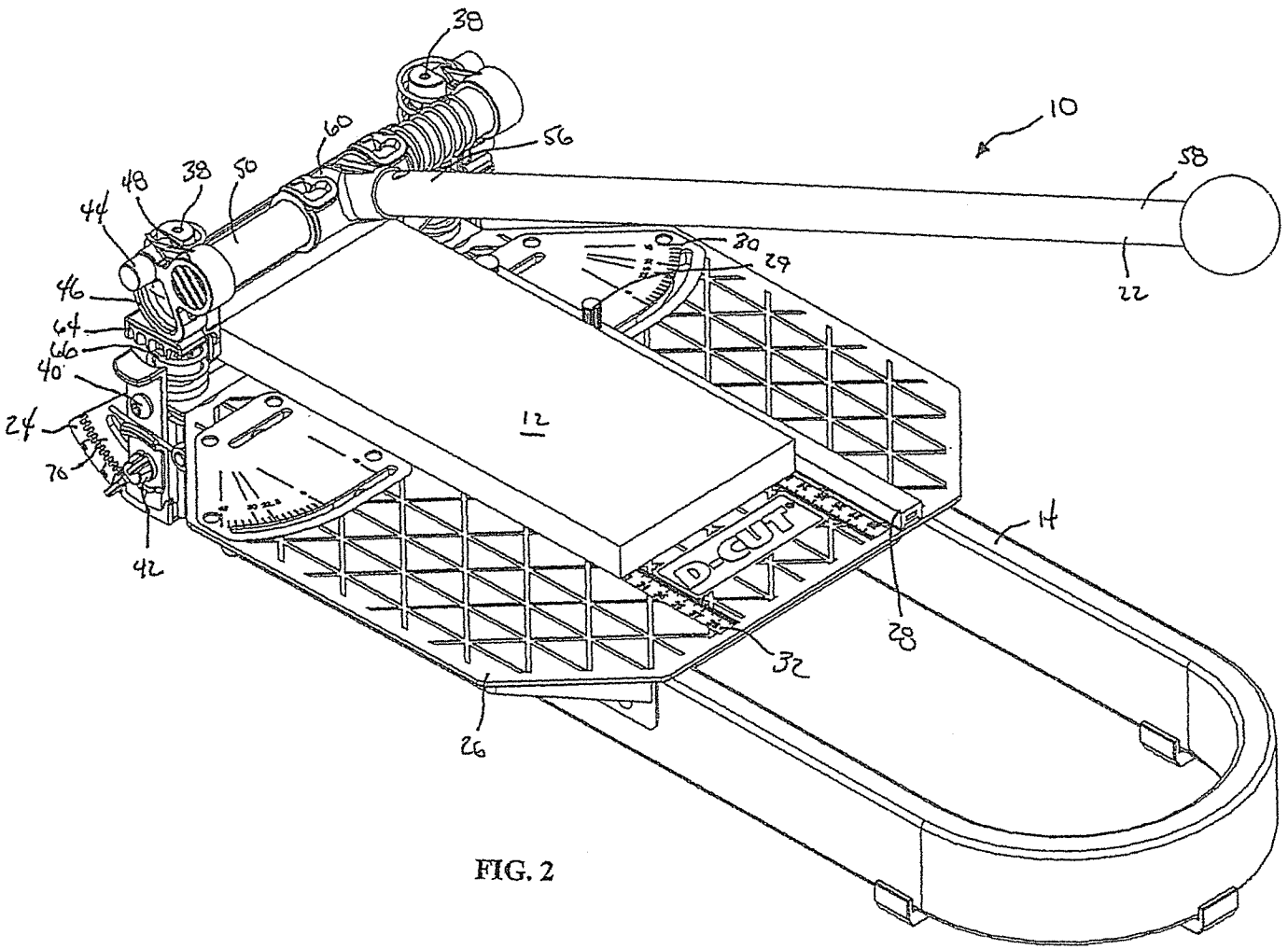
FIG. 2 is a perspective view of the cutting tool shown in FIG. 1 with a sheet of material.

FIGS. 1 and 2 show a perspective view of a cutting tool 10 according to one embodiment of this invention. The cutting tool 10 as described is preferably used to cut building materials 12, such as laminate, in a predictable and straight fashion without splintering, cracking or similar problems that may arise from such cuts. The cutting tool 10 is capable of cutting the building material 12 at a range of angles from 0°, vertical, to approaching 90°, and preferably ranging from 0° to 60° from vertical. The cutting tool 10 is also capable of cutting the building material at a range of angles in a horizontal plane, ranging from 0°, perpendicular to the blade, to 45° or more. The vertical adjustment allows the cutting tool 10 to cut materials to, for example, fit around or in corners and the horizontal adjustment allows the cutting tool 10 to cut materials to, for example to fit around window or door frames.

As used herein, "material" refers to a sheet or plank of building material, such as baseboards, crown molding, chair rail molding, wood flooring, laminate flooring, composite flooring, vinyl flooring, vinyl siding, vinyl composition tile or similar materials, including, but not limited to, one or more combinations of wood, fiber, concrete, plastic and/or other materials that may or may not include a laminated layer.

As shown in FIGS. 1-8, the cutting tool 10 includes a base 14, a cutting platform 16, a blade holder 18 and blade 20, and a handle 22. The cutting platform 16 is preferably connected to the base 14 with an adjustable, lockable, pivotable connection 24 allowing the cutting platform 16 to be set at a plurality of angles to the base 14. For example, the pivotable connection 24 may comprise a hinge, an axle or any other connection that allows the cutting platform 16 to pivot relative to the base 14.

In an embodiment of the invention, the base 14 comprises a U-shape base that provides stability for the cutting tool 10, however the base 14 is not limited to this shape and may comprises any shape that provides a stable base for the cutting tool 10. The base 14 may be formed of steel, aluminum or another material with durable qualities capable of withstanding the force required to cut the building materials 12.

The base 14 preferably includes a support surface 26 for accommodating the material 12 to be cut. The support surface 26 preferably includes a textured or a high friction, non-slip surface that prevents the building material from slipping or moving during cutting process. The support surface 26 is preferably made of lightweight and durable materials, such as plastic, rubber, metal and composite materials, but may be made of any material capable of supporting the building materials 12 and withstanding the cutting force. The base 14 and support surface 26 are preferably sized to accommodate standard sizes of materials 12, such as a baseboard, and may correspond in width to such material 12.

The cutting tool 10 preferably further includes an adjustable guide rail 28 and a track 30 on the support surface 26 that can be used to align the building material 12 at a range of angles, along a horizontal plane, to the blade 20. In the embodiment shown in FIG. 1, the guide rail 28 is connected to one of the tracks 30 with a pair of adjustment screws 29. The guide rail 28 is positioned perpendicular to the blade but can be moved along the track 30 to provide additional room for the building material 12 and/or adjusted to a range of angles to the blade 12 from 0°, perpendicular to a 45° or more. The support surface may further include a ruler 32 for measuring the material 12 to be cut.

Figure 3A:
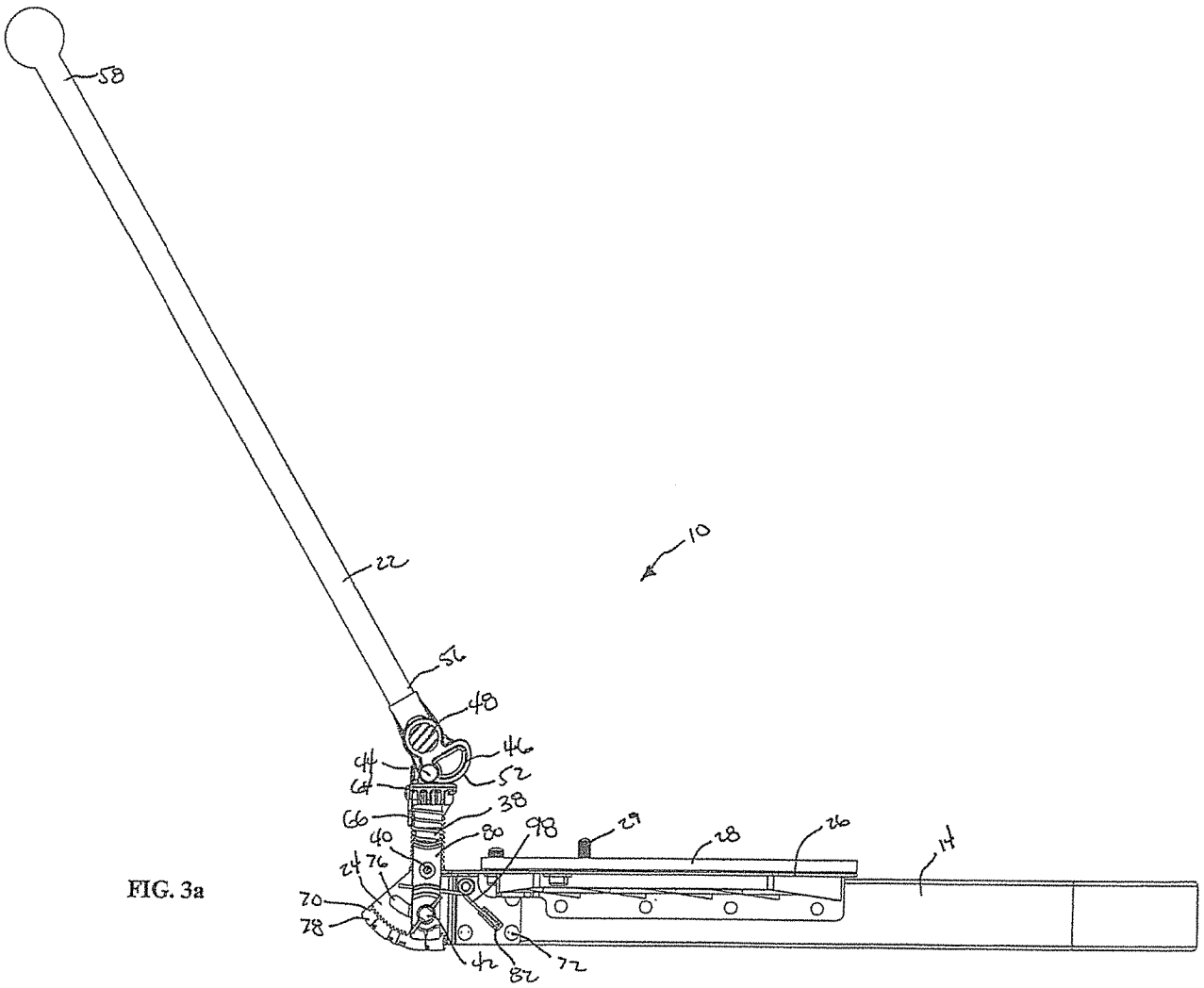
FIG. 3*a* is a side view of the cutting tool shown in FIG. 1 in an open position.
Figure 3B:
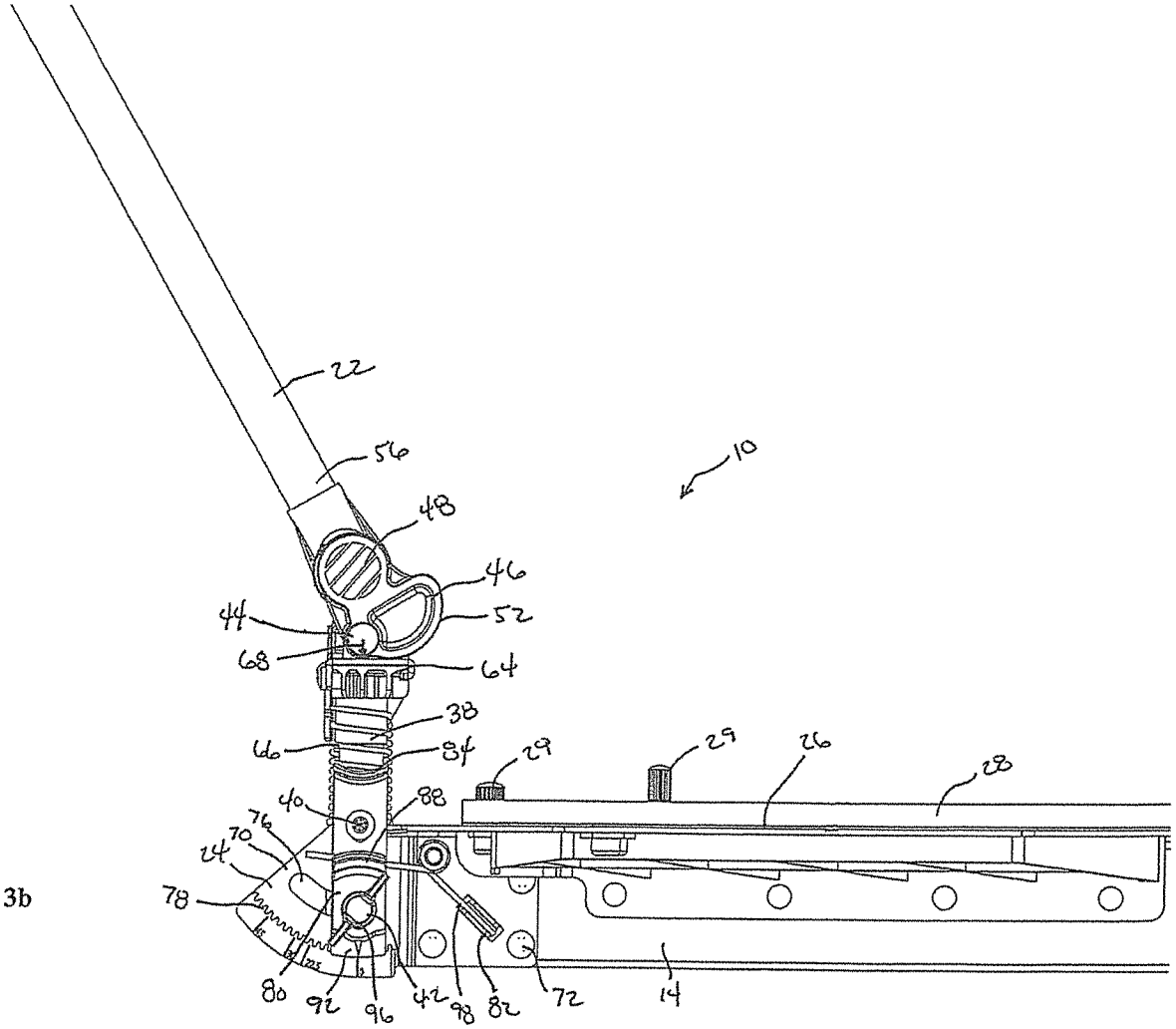
FIG. 3*b* is a close-up of the side view shown in FIG. 3*a*.
Figure 4A:
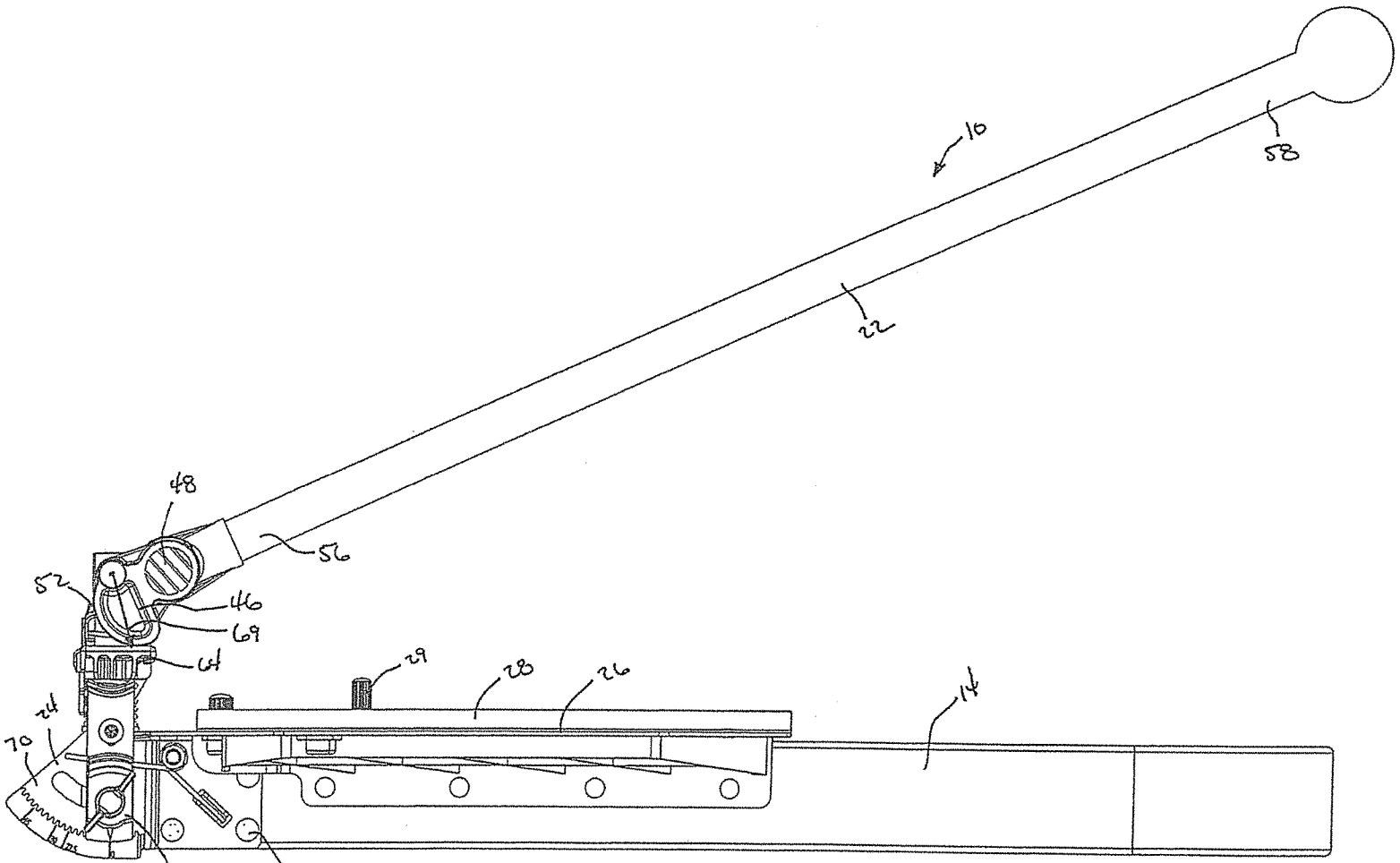
FIG. 4*a* is a side view of the cutting tool shown in FIG. 1 in the closed position.
Figure 4B:
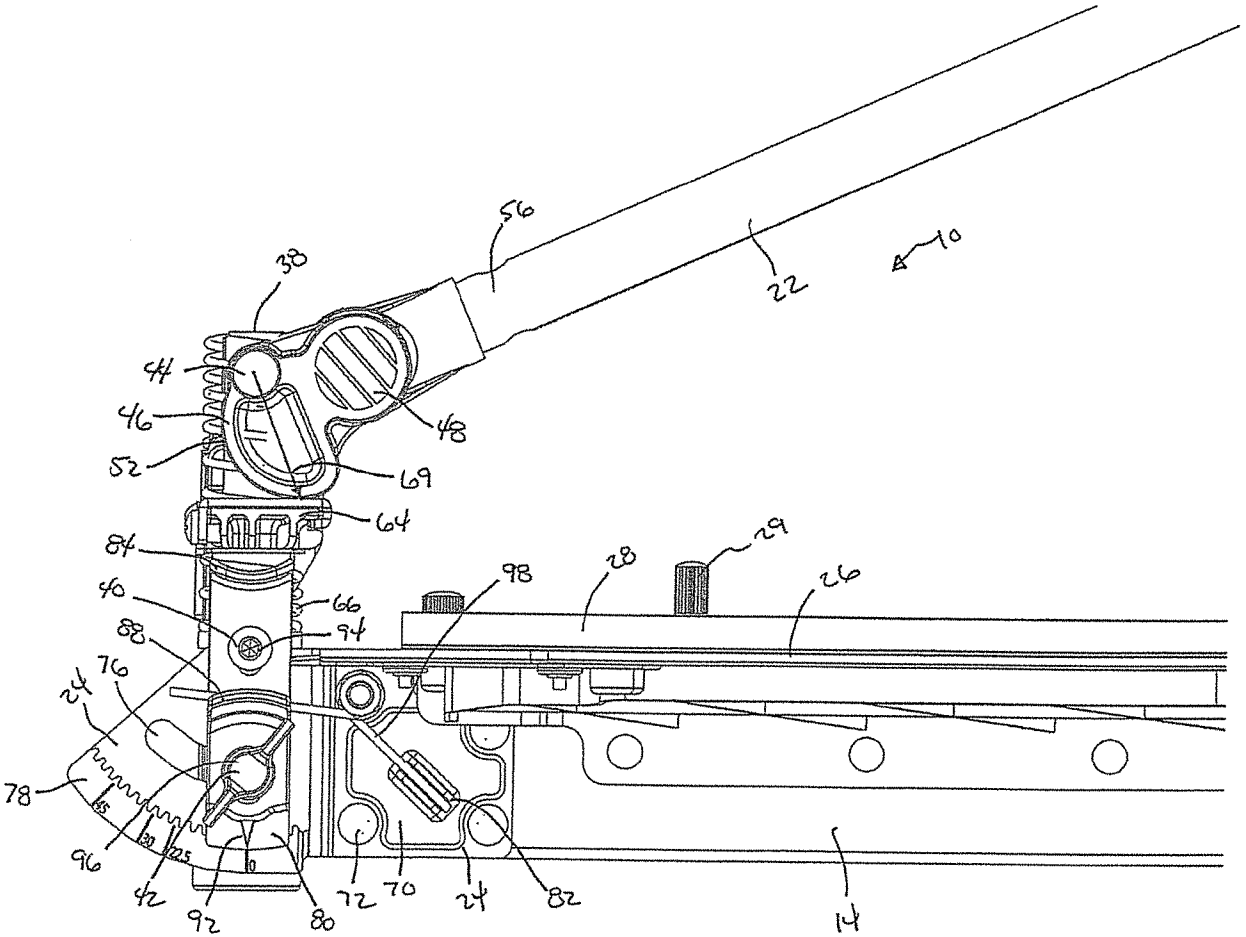
FIG. 4*b* is a close-up of the side view shown in FIG. 4*a*.
Figure 5A:
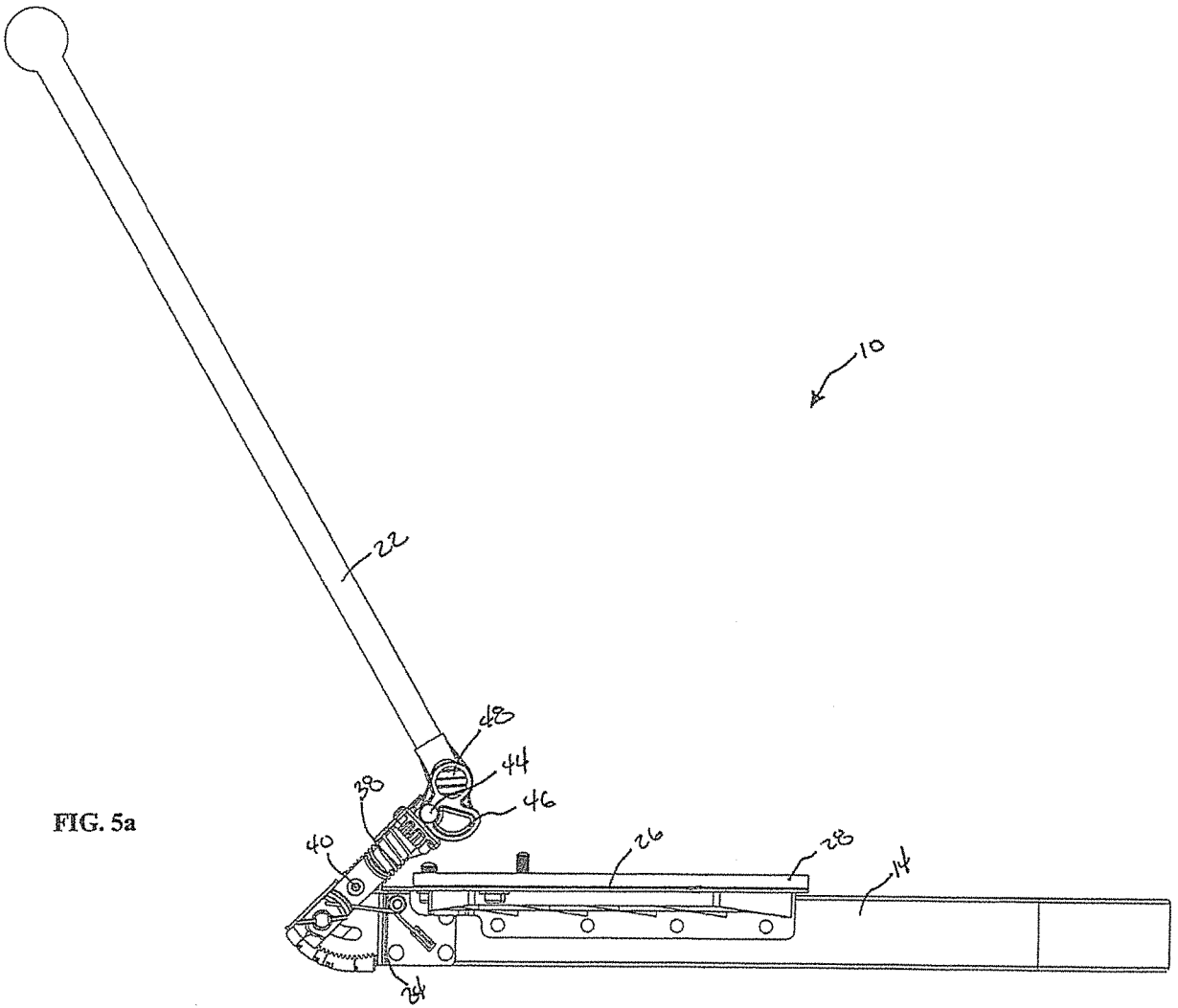
FIG. 5*a* is a side view of the cutting tool shown in FIG. 1 in the open position with a cutting platform set at a 45° angle.
Figure 5B:
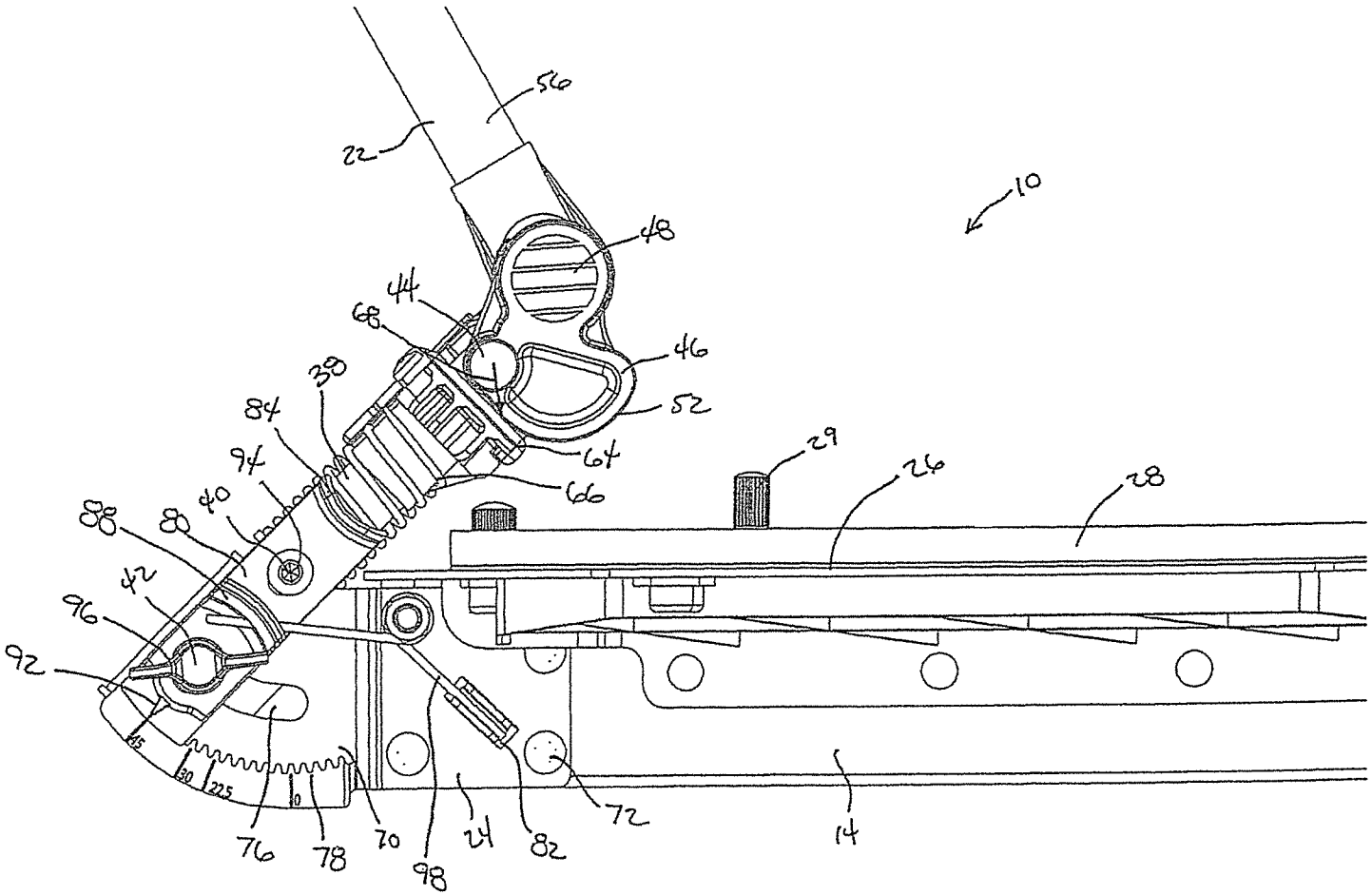
FIG. 5*b* is a close-up of the side view shown in FIG. 5*a*.

In a preferred embodiment of this invention, the cutting platform 16 is connected to the base 14 with the hinge 24 allowing the cutting platform 16 to be set at a plurality of angles to the base 14. For example, FIG. 3*a-b* and 4*a-b* show the cutting platform 16 aligned with the base 14 for a vertical cut or 0° cut. FIGS. 5*a-b* show the cutting platform 16 aligned with the base 14 for a 45° cut. In the embodiment of FIGS. 3*a*-5*b*, the cutting platform 16 can be set at a plurality of angles ranging from 0° to greater than 45°. However, the cutting tool 10 of this invention can be designed to cover any range of angles including from 0° to approaching 90°.

Figure 9A:
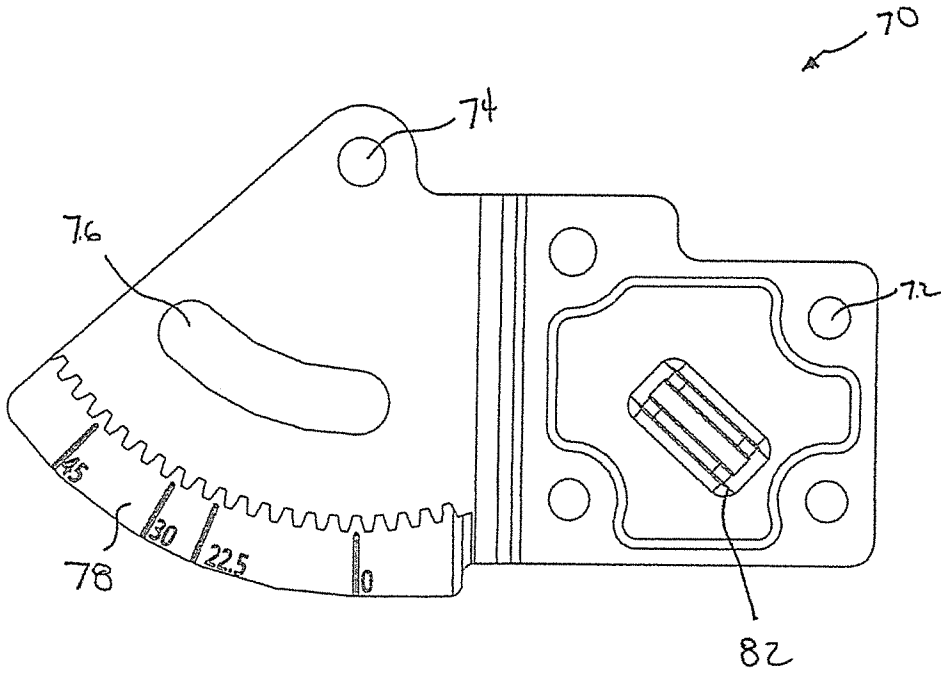
FIG. 9*a* is a side view of a hinge plate according to an embodiment of this invention.
Figure 9B:
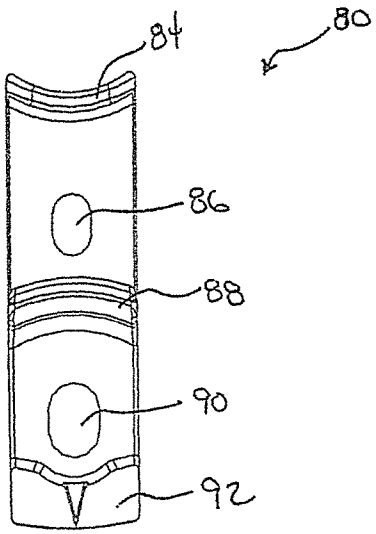
FIG. 9*b* is a side view of a hinge lock according to an embodiment of this invention.

FIGS. 9*a-b* shows an embodiment of two components of hinge 24 separate from the other components of the cutting tool 10. FIG. 9*a* shows an embodiment of a hinge plate 70 of the hinge 24. FIG. 6*b* shows an embodiment of a hinge lock 80 of the hinge 24.

The hinge plate 70 comprises a plurality of attachment points 72 for connecting the hinge plate 70 to the base 14 with rivets, threaded connectors or any other type of connectors. In an alternative embodiment, the hinge plate 70 can be connected to the base 14 with a weld connection or integrally formed with the base 14. The hinge plate 70 further includes an axle hole 74, a platform slot 76, a rack 78 and a spring mount 82 for adjusting the position of the cutting platform 16 to the base 14. As shown in FIG. 6*b*, the hinge lock 80 includes a lift 84, an oval axle hole 86, a spring catch 88, an oval platform hole 90 and a locking projection 92. The cutting platform 16 is connected to the hinge 24 with a platform axle 40 and a platform projection 42. The platform axle 40 extends through the axle hole 74 and the oval axle hole 86 of the hinge 24 and is secured with a fastener 94, providing an axis of rotation for the cutting platform 16. The platform projection 42 extends through the platform slot 76 and the oval platform hole 90 of the hinge 24 and secured with a fastener 96 preferably a wing nut, limiting the rotation of the cutting platform 16 to an angle range defined by the platform slot.

To lock the cutting platform 16 to an angle, the cutting platform 16 and the hinge lock 80 are aligned with the desired angle on the rack 78. A hinge spring 98 positioned between the spring mount 82 and the spring catch 88 presses the locking projection into the teeth of the rack 78 locking the cutting platform to the desired angle. Preferably, the cutting platform 16 is further secured by tightening the wing nut 96 or another similar mechanical connector. To adjust the angle of the cutting platform 16, the wing nut 96 is loosened and the lift 84 pulled upward, disengaging the locking projection 92 from the teeth of the rack 78. The cutting platform 16 is rotated about platform axle 40 and through the platform slot 76 to the newly desired angle. The lift 84 is released allowing the locking projection 92 to mate with the teeth of the rack 78 and the wing nut 96 is retightened, securing the cutting platform 16 at the new angle. In an alternative embodiment, the hinge 24 may not include the rack 78, the spring mount 82, the lift 84, the spring catch 88, the locking projection 92, and/or the hinge spring 98. In this alternative embodiment, the cutting platform is secured by tightening the wing nut 96 at a desired angle.

Figure 6A:
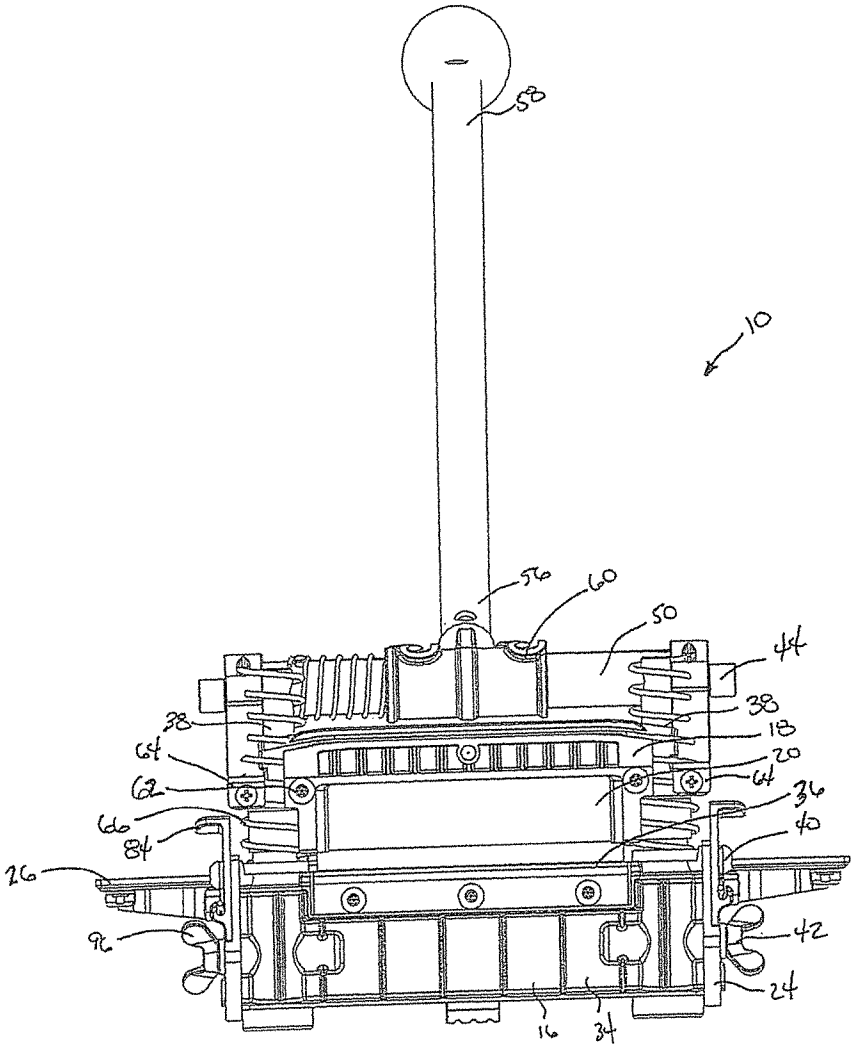
FIG. 6*a* is a rear view of the cutting tool shown in FIG. 1 in the closed position.
Figure 6B:
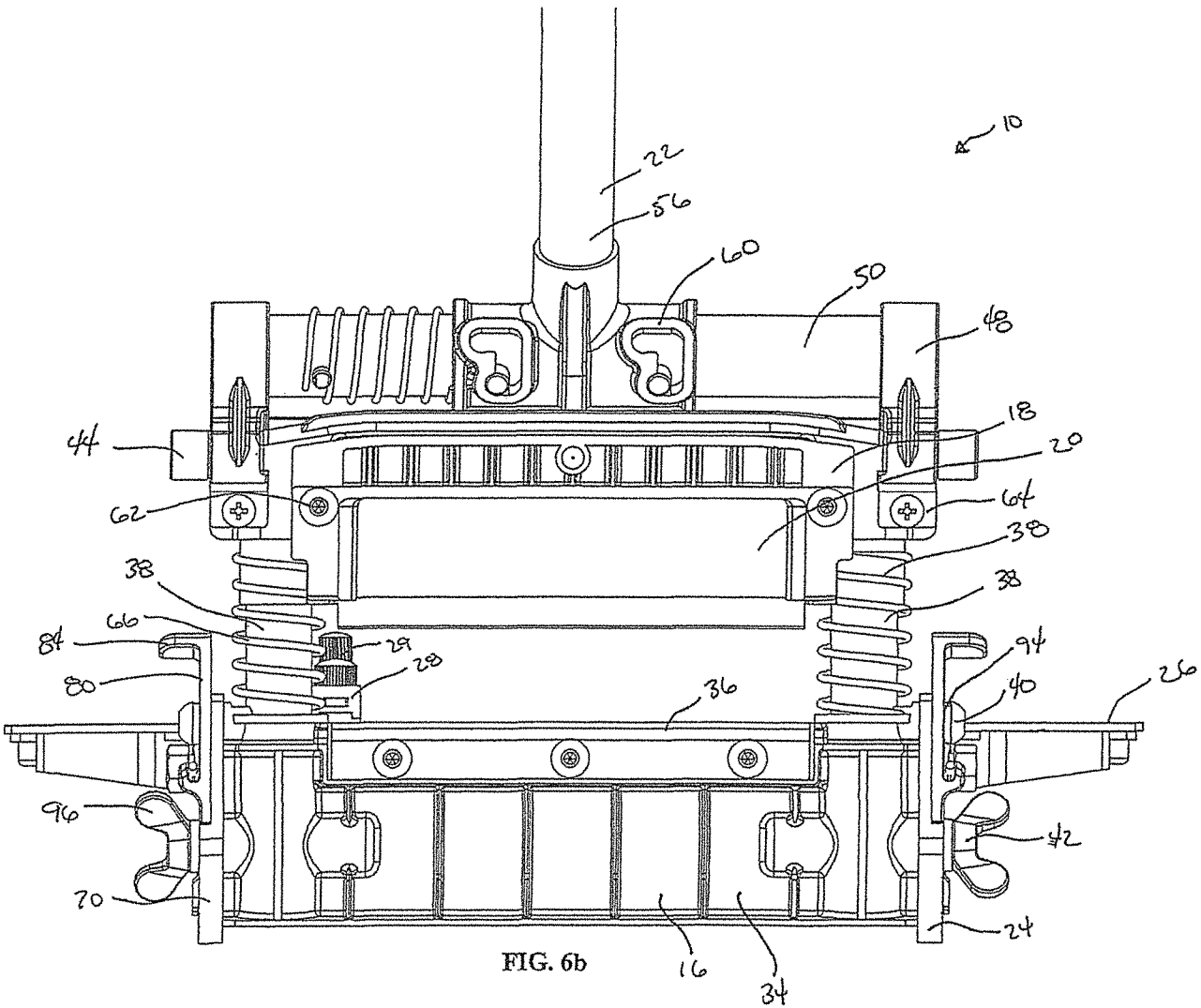
FIG. 6*b* is a rear view of the cutting tool shown in FIG. 1 in the open position.
Figure 7:
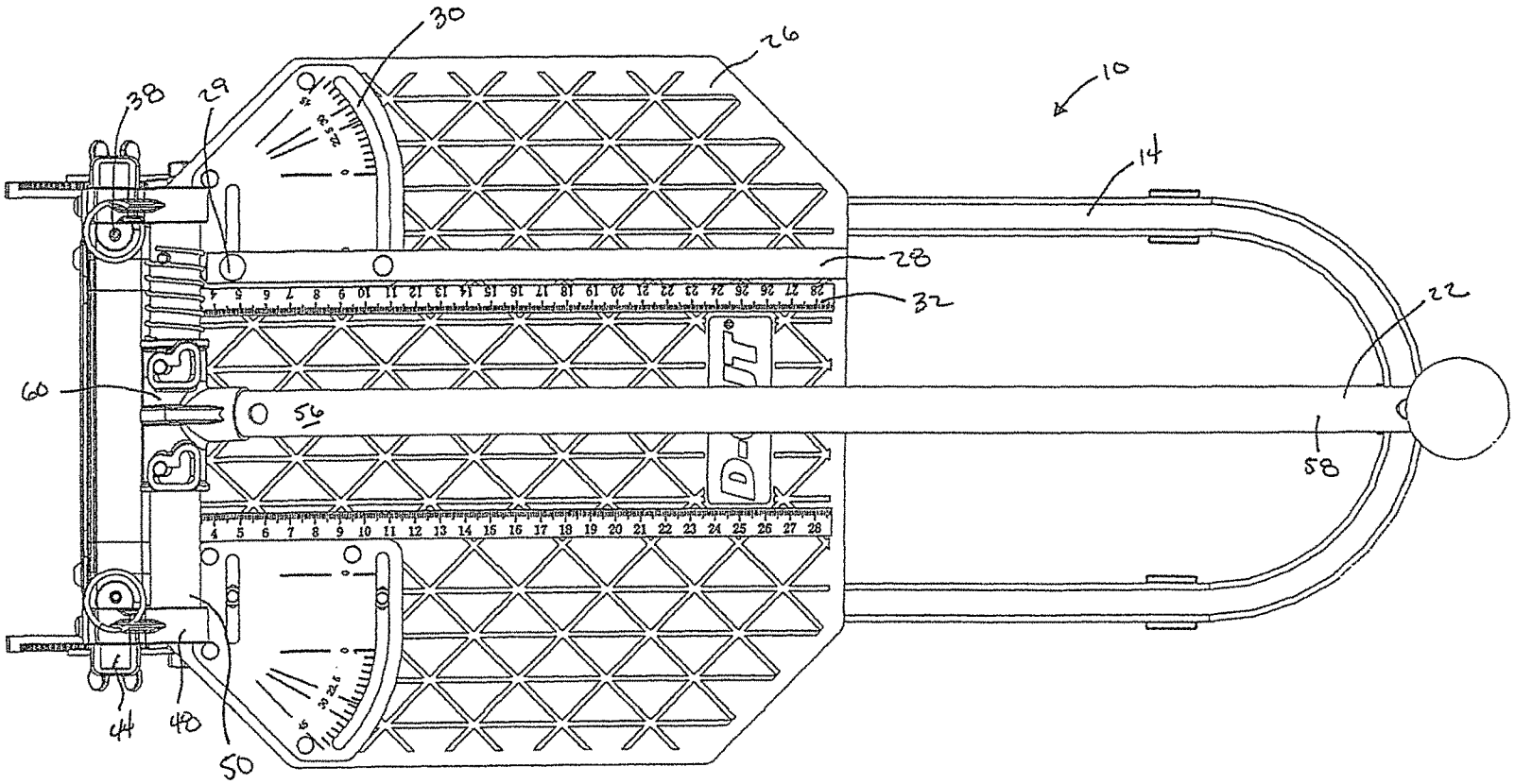
FIG. 7 is a top view of the cutting tool shown in FIG. 1.
Figure 8:
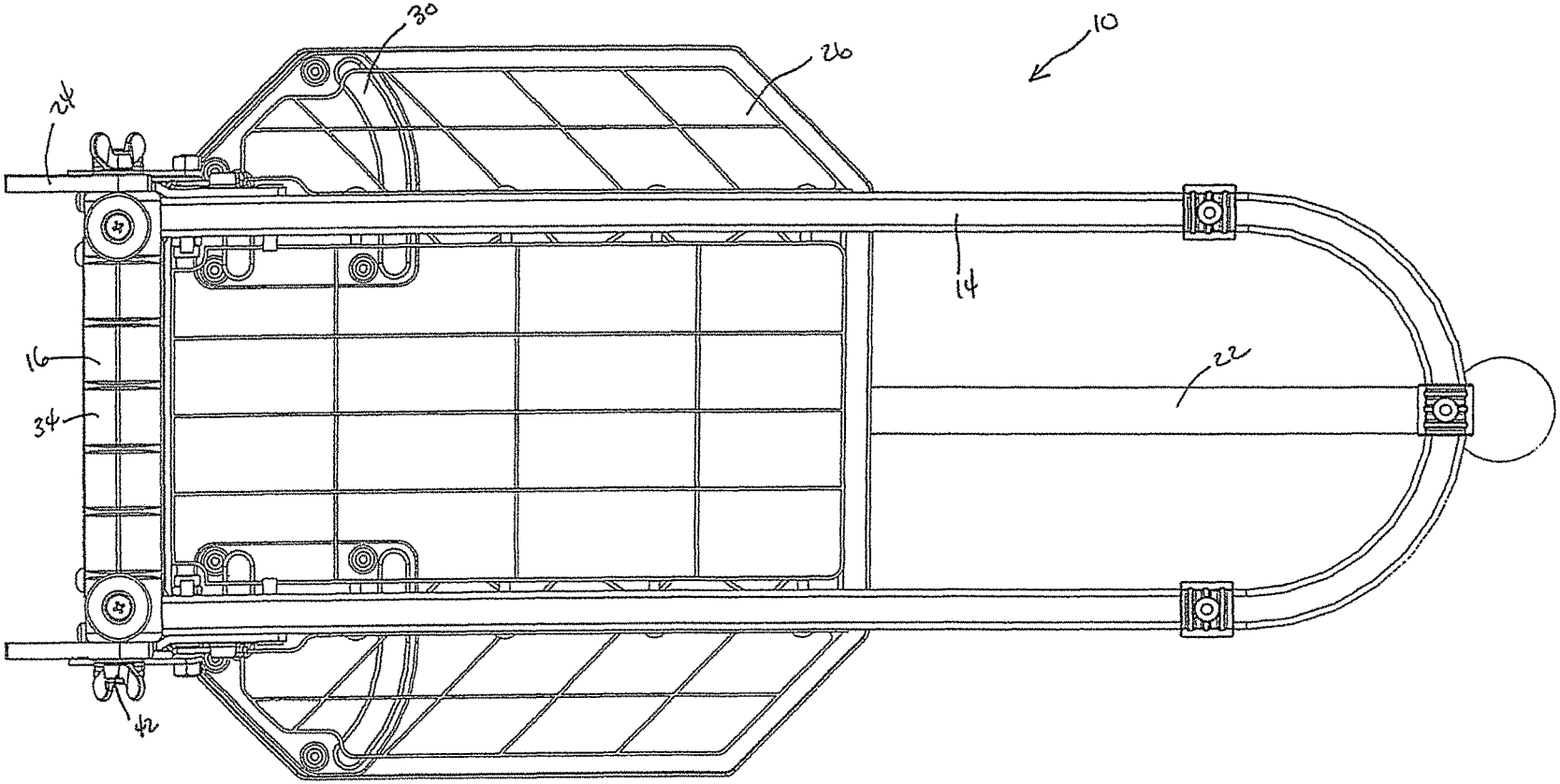
FIG. 8 is a bottom view of the cutting tool shown in FIG. 1.

In a preferred embodiment of this invention, as best shown in FIGS. 6*a*-b, the cutting platform includes a cutting platform base 34, a blade stop 36, and a pair of supports 38 extending from the cutting platform base 34. The cutting platform 16 is preferably manufactured of steel but may comprise any material or materials capable of withstanding the force required to push the blade 20 through the building material 12.

Figure 10:
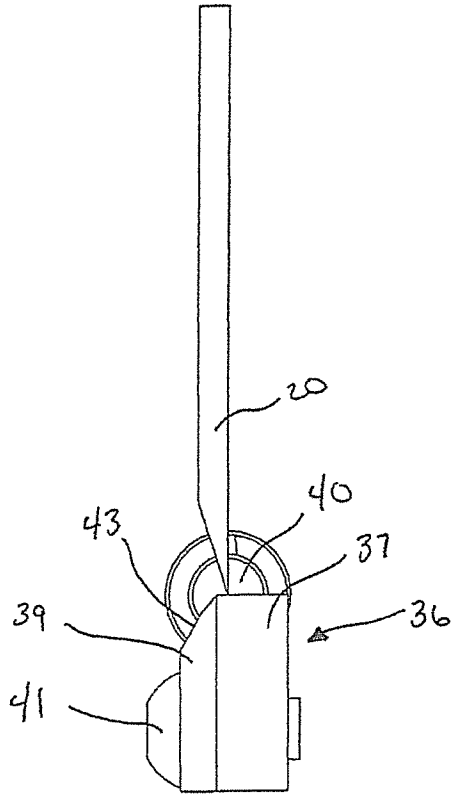
FIG. 10 is a side view of a blade, a blade stop and a platform axle according to one embodiment of this invention.

In a preferred embodiment, as best shown in FIG. 10, the blade stop 36 includes a contact element 37 and a brace 39. The contact portion 37 is preferably manufactured of a softer material that causes minimal damage to an edge of the blade 20 such as, but not limited to, nylon. The brace 39 is preferably manufactured of a durable material such as, but not limited to, steel and aluminum. Preferably, the contact element 37 and the brace 39 are connected to the cutting platform base 34 with a threaded connection 41 that allows the contact portion 37 to be easily replaced as it wears. As best shown in FIG. 10, in a preferred embodiment, the brace 39 includes a sloped top edge 43. This sloped edge 43 prevents the blade stop 36 from projecting over a plane of the support surface 26 as the cutting platform 16 is set to an angle other than 0°.

As best shown in FIGS. 6*a-b*, the pair of supports 38 are connected to the cutting platform base 34 extending generally perpendicular to a plane of the blade stop 36. The pair of supports 38 may be formed of materials such as steel or similar rigid material. In this embodiment, the pair of supports 38 are integrally formed with the cutting platform base 34 and are positioned on either side of the cutting platform base 34 at a width sufficient to accommodate standard sizes of material 12, such as but not limited to base boards and crown molding. In other embodiments, the pair of supports 38 can be welded to or connected with a mechanical connection, such as a threaded connection, to the cutting platform base 34 or connected in any other means known to one of skill in the art. In an alternative embodiment, the cutting tool 10 may include a single support 38.

As shown in the figures, each support 38 includes an axle 44 connected to a cam 46. Each cam 46 includes an offset 48, the pair of offsets 48 are connected by a beam 50. In an alternative embodiment, the offsets 48 and beam 50 can be replaced with a single axle, not shown, extending between the pair of supports 38 and the cam 46 connected to the single axle. As shown in FIGS. 3*b*, 4*b* and 5*b*, each cam 46 further includes a cam edge 52 with at least two radii and preferably with a gradually increasing radius.

In a preferred embodiment, this invention includes the handle 22 with a proximate end 56 and a distal end 58. The proximate end 56 is attached to the beam 50 to assist a user to rotate the cams 46. In a preferred embodiment, the proximate end 56 is connected to the beam 50 with an adjustable connection 60. The adjustable connection 60 allows the handle 22 to be set in at least two positions to compensate for the angle of the cutting platform 16, allowing the handle 22 to rotate fully from the open position to the closed position and to prevent the handle 22 from contacting the base 14. In an alternative embodiment, the handle may not include the adjustable connection and the attachment can be formed in various ways including, but not limited to, a threaded connection, a welded connection or an integral connection with the beam 50. The distal end 58 of the handle 22 preferably includes a hand grip for the user to manually grab or engage. In an alternative embodiment, the handle 22 may be extendible to provide a longer lever for cutting the material 12.

As shown in FIGS. 6*a-b*, the blade holder 18 and the blade 20 are positioned between the pair of supports 38, where the pair of supports act as guides for the blade holder 18 to maintain a generally straight path as the blade holder 18 moves from the open position to the closed position. The blade holder 18 may be formed of a material such as steel or similar rigid material. The blade 20 is preferably formed of steel or another material capable of repeatedly cutting all thicknesses and compositions of material 12. In a preferred embodiment, the blade 20 is attached to the blade holder 18 with a threaded connection 62. With this arrangement, the blade 20 can be removed from the blade holder for repairs, sharpening and to select a specialty blade for a type of material 12. In an alternative embodiment, the blade can be integrally formed with the blade holder 18.

As best shown in FIGS. 6*a-b*, each outer edge of the blade holder 18 at least partially surrounds a respective support 38. Outside of each support 38, the blade holder 18 includes a shoulder 64. Each shoulder 64 is positioned under and in contact with a respective cam 46. As each cam 46 rotates, the increasing radius of the cam edge 52 forces the shoulder 64 and the blade holder 18 downwards from the open position to the closed position. In an alternative embodiment, the cam 46 may contact the blade holder 18 at a position between the two supports 38.

According to a preferred embodiment, the blade holder 18 and blade 20 are biased upward into the open position by a spring 66. As shown in the figures, the spring 66 is positioned between the cutting platform 16 and the blade holder 18. In this embodiment, the spring 66 wraps around the support 38. In an alternative embodiment, the spring 66 may not wrap around the support 38. As the blade holder 18 travels downward, the spring 66 is compressed to further urge a uniform cut of the blade 20 through the material 12. The strength and configuration of the spring 66 may be adjusted depending on the desired application.

In a preferred embodiment, the blade 20 moves downward in a plane that is coplanar with the axis of rotation of the platform axle 40 and, as best shown in FIG. 10, the blade 20 contacts the blade stop 36 along a line that is collinear with the axis of rotation of the platform axle 40 of the cutting platform. Specifically, in this embodiment, the blade 20 contacts the nylon contact portion at 1 mm from the brace 39. This arrangement maintains the alignment of the blade 20 to provide a straight cut through the material 12, regardless of the selected angle of the cutting platform 16 and prevents splintering and/or cracking the material 12.

In operation, the cutting tool 10 of this invention starts in the open position as shown in FIGS. 3*a-b*, 5*a-b* and 6*b*. In the open position, the spring 66 biases the blade holder 18 and the blade 20 upward and the cam 46 contacts the shoulder 64 of the blade holder 18 at a relatively small radius 68, this provides an opening between the blade 20 and the blade stop 36 of the cutting platform 16. The material 12 to be cut is placed onto the support surface 26 of the base 14 and through the opening formed between the blade 18 and the cutting platform 16. To cut the material 12, the handle 22 is lowered to rotate the cam 46. By rotating the cam 46, a gradually increasing radius of the cam edge 52 pushes the blade holder 18 and blade 20 downward through the material 12 until a large radius 69 of the cam 46 contacts the shoulder 64 and the blade 20 contacts the blade stop 36 thereby severing the material 12. The resulting cut is optimally free of splinters and a resulting cut end of the material is otherwise clean and straight.

Figure 11:
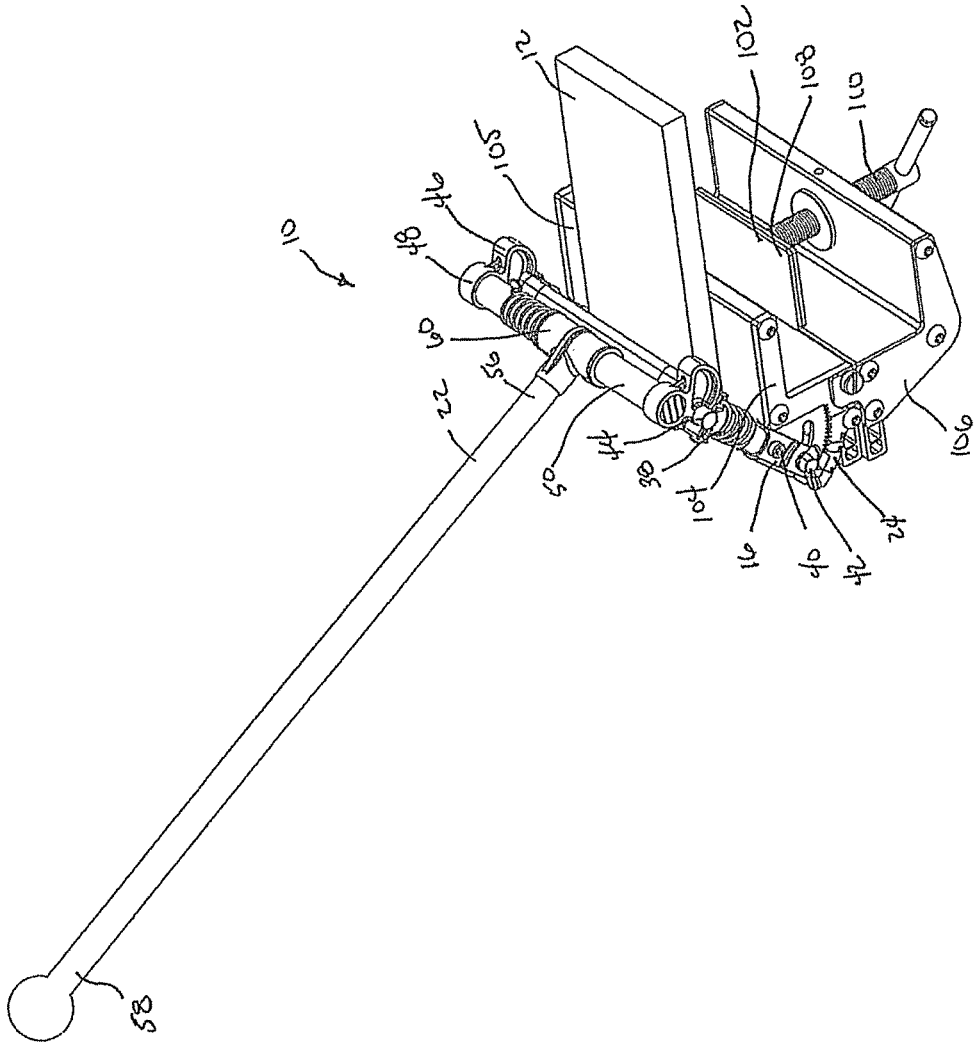
FIG. 11 is a perspective view of another embodiment of the cutting tool of this invention.
Figure 12:
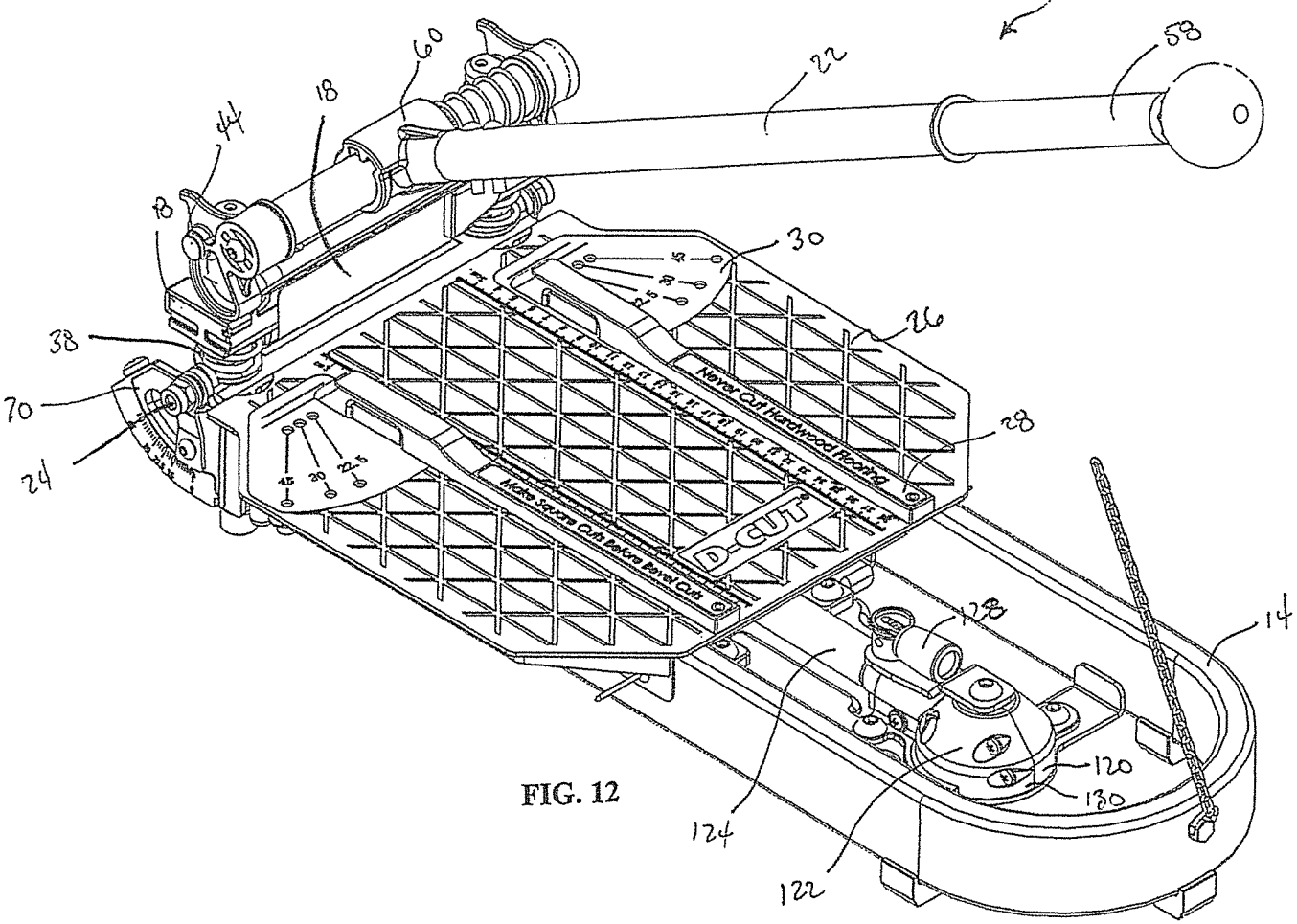
FIG. 12 is a perspective view of another embodiment of the cutting tool of this invention.

In an alternative embodiment of this invention, the cutting tool 10 may not include a base and may be attachable to a work table or another surface. In the alternative embodiment shown in FIG. 11, the cutting tool 10 includes a clamp 102 in place of the base described above. In this embodiment, the cutting platform 16, the blade holder 18, the blade 20 and the handle 22 remain similar to the description above. The clamp 102 preferably includes an upper bracket 104 with a support surface 105, a lower bracket 106 and a clamping platform 108 with a threaded adjustment rod 110. In this embodiment, the upper bracket 104 is connected to the adjustable hinge 24. The lower bracket 106 is connected to upper bracket 104 with a threaded connection. Alternatively, the lower bracket 106 can be connected to the upper bracket with a weld connection or the lower bracket 106 can be integrally formed with the upper bracket 104. The threaded adjustment rod 110 extends through the lower bracket 106 and is adjustable to pinch a work surface between the support surface 105 and the clamping platform 110 to prevent the cutting tool 10 from moving during cutting. Alternatively, the cutting tool 10 may be attached to the work surface with a screw through either the upper bracket 104 or the support surface 105 and the work surface.

Figure 13:
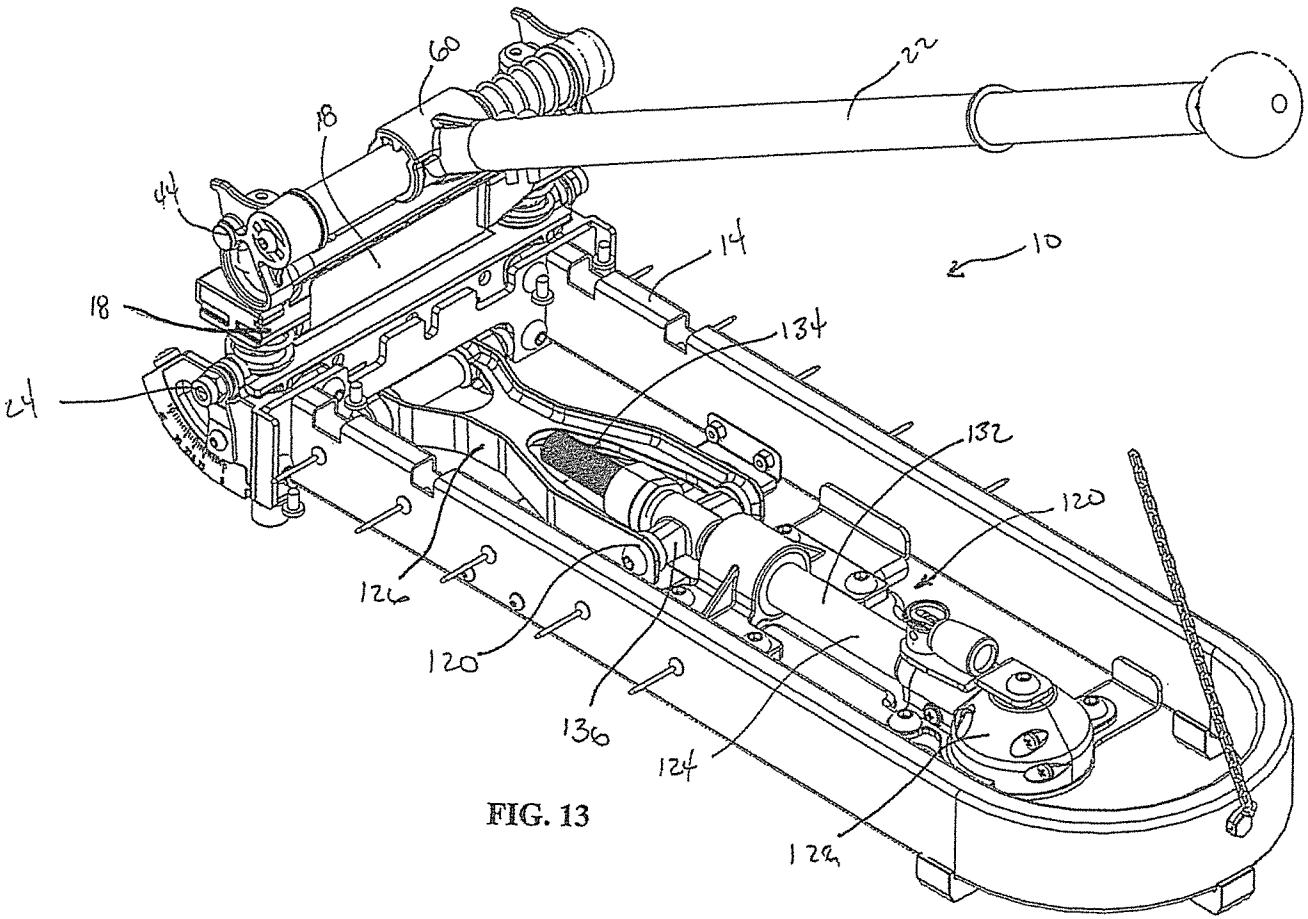
FIG. 13 is a perspective view of the cutting tool of FIG. 12 with a support surface removed.
Figure 14:
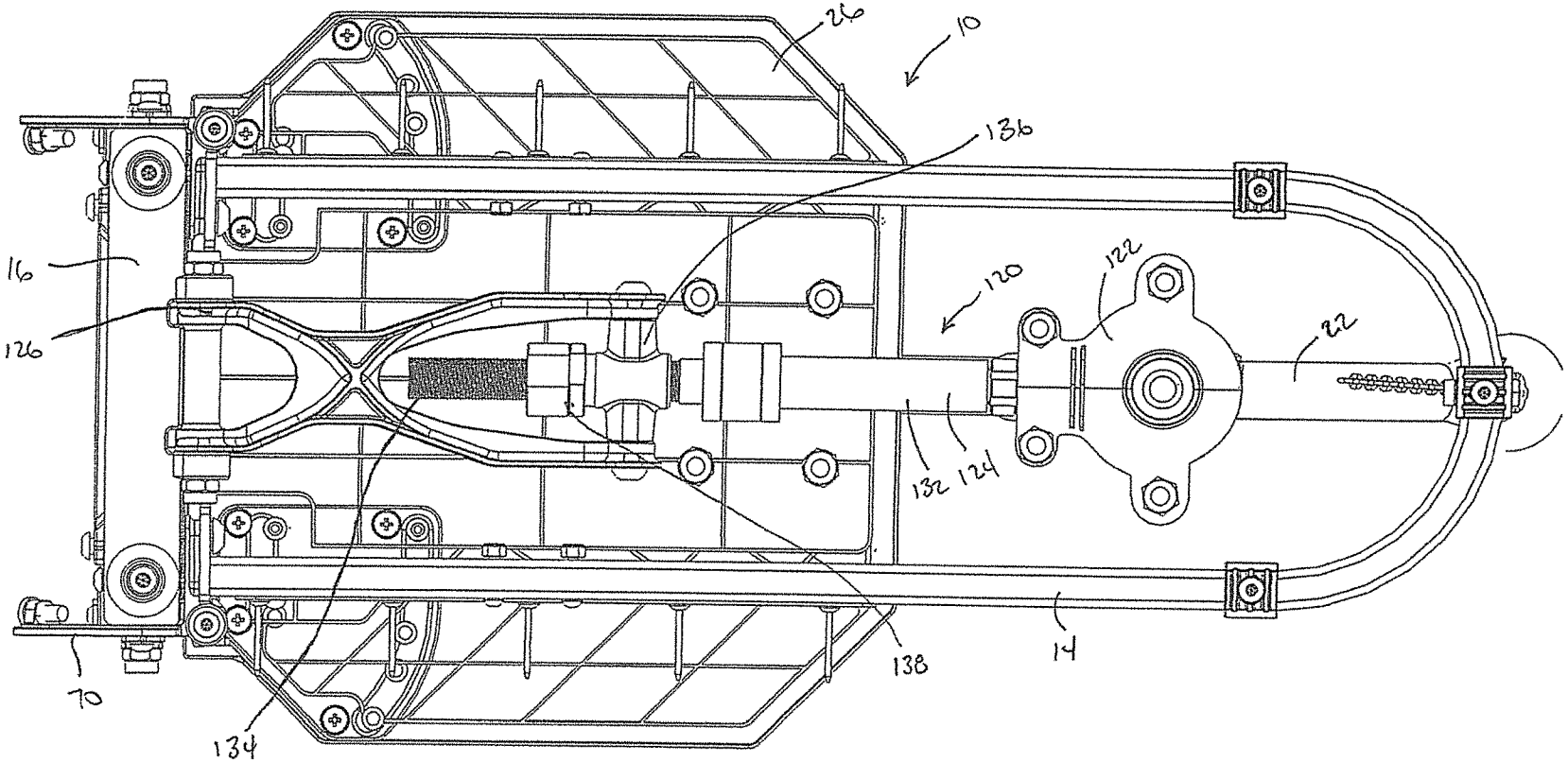
FIG. 14 is a bottom view of the cutting tool shown in FIG. 12 with a base plate removed and a cutting platform set perpendicular to a base.
Figure 15:
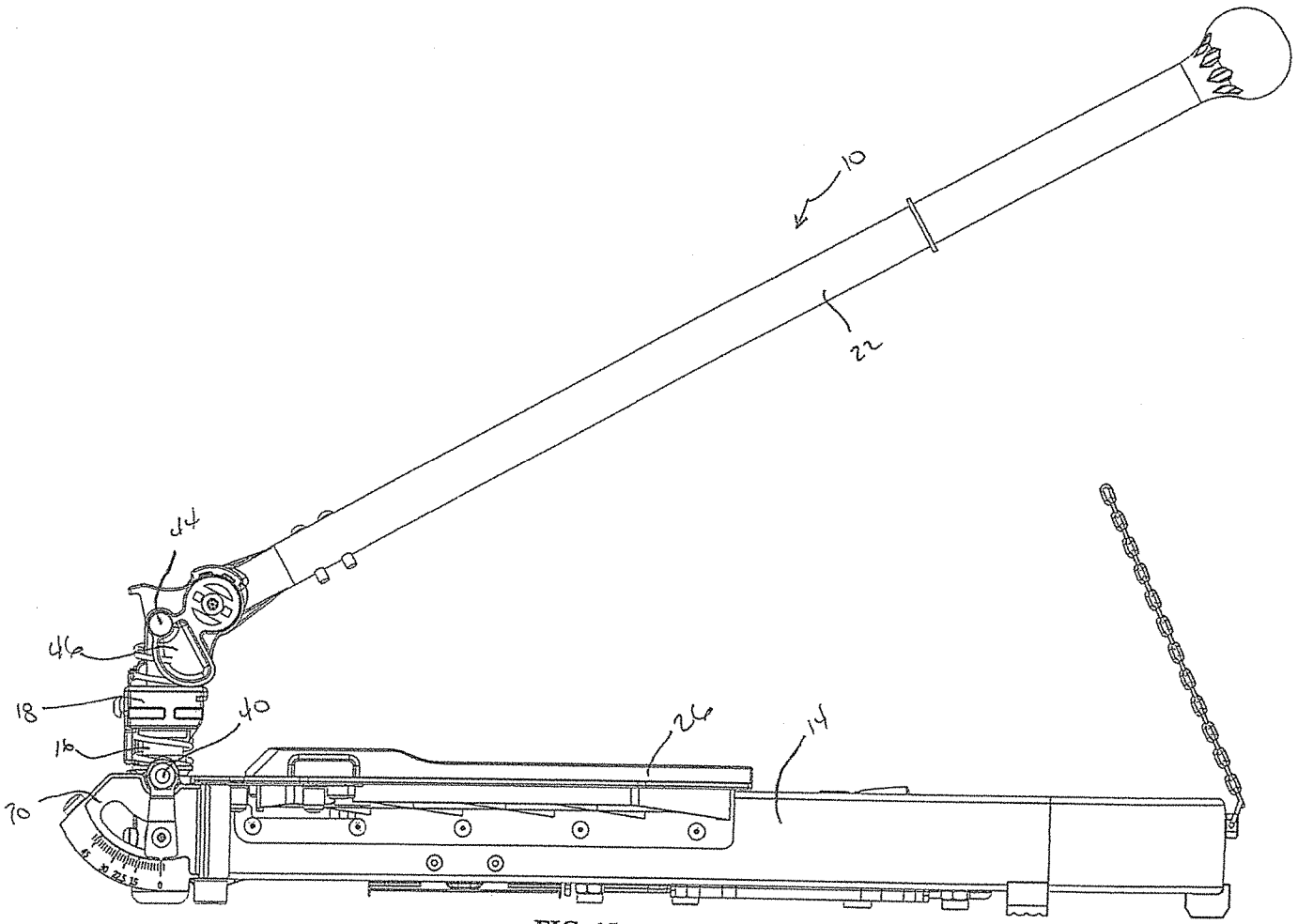
FIG. 15 is a side view of the cutting tool shown in FIG. 14.
Figure 16:
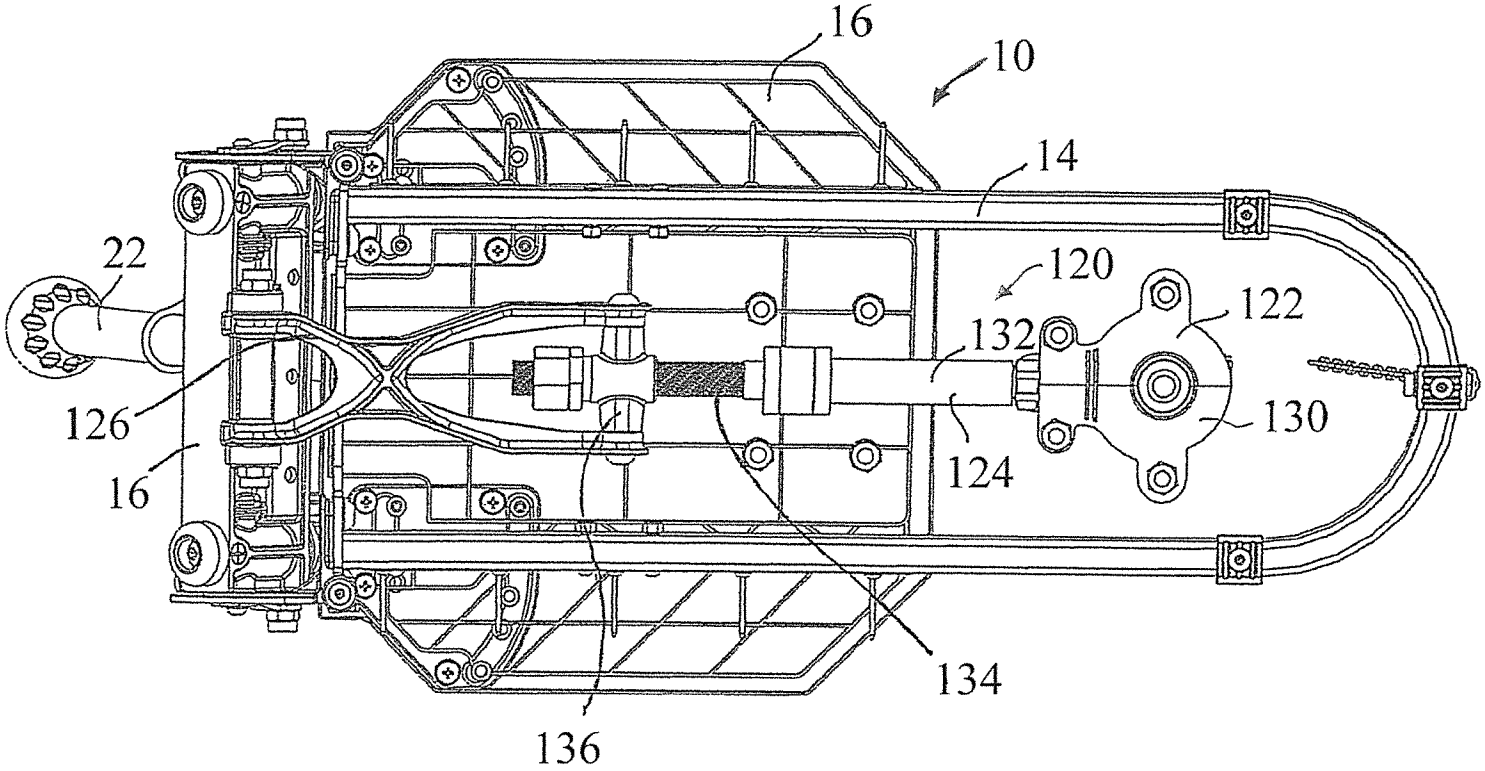
FIG. 16 is a bottom view of the cutting tool shown in FIG. 12 with the base plate removed and the cutting platform set at a 45° angle to the base.
Figure 17:
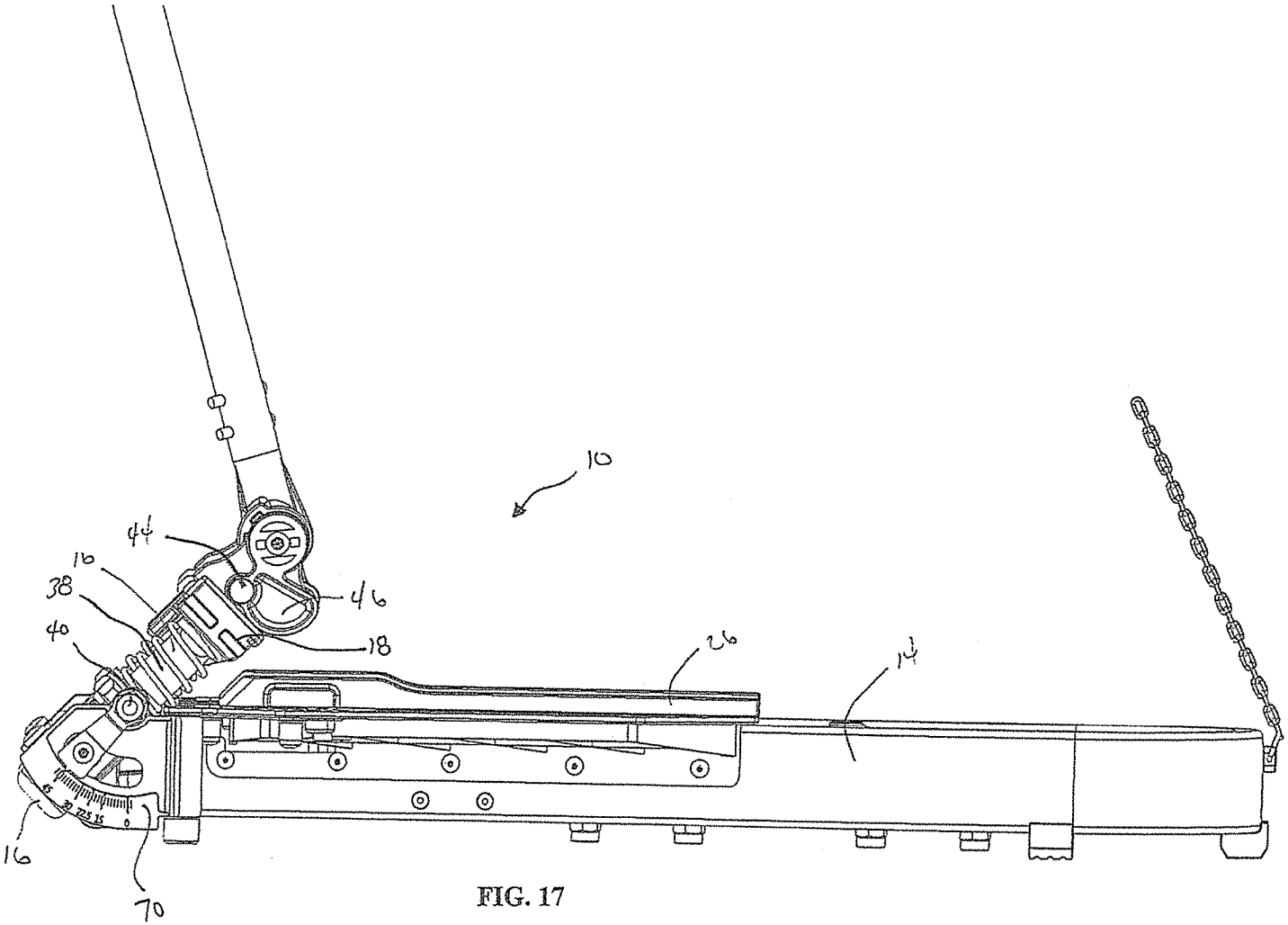
FIG. 17 is a side view of the cutting tool shown in FIG. 16.

FIGS. 12-17 show another embodiment of the cutting tool 10 of this invention. The embodiment shown in FIGS. 12-17 is similar to the cutting tool shown in FIGS. 1-10 with a cutting platform actuator 120 for changing an angle of the cutting platform 16 relative to the base 14. Preferably, as best shown in FIGS. 15 and 17, the cutting platform actuator 120 is capable varying the angle between the cutting platform 16 and the base 14 from 0°, a vertical cut (the blade 20 perpendicular to the base 14) to greater than a 45° angle.

However, the angle is not limited to this range and may comprise any angle between the cutting platform 16 and the base 14 ranging from 0° to approaching 90°.

The cutting tool 10 of FIGS. 12-17 includes the base 14, the cutting platform 16, the blade holder 18 and the blade 20, and the handle 22. The cutting platform 16 is preferably connected to the base 14 with an adjustable, pivotable connection 24 allowing the cutting platform 16 to be set at a plurality of angles to the base 14 using the cutting platform actuator 120. The base 14 further includes a support surface 26 for the material to be cut.

As best shown in FIGS. 13, 14 and 16, the cutting platform actuator 120 operates to adjust and set the cutting platform 16 at a plurality of angles to the base 14. For example, a 0° angle, as shown in FIGS. 14 and 15, and a 45° angle, as shown in FIGS. 16 and 17. In this embodiment, the angle may range from 0° to greater than 45°. However, the cutting tool 10 of this invention can be designed to cover any range of angles including from 0° to approaching 90°. In a preferred embodiment, the cutting platform actuator 120 comprises a hand crank 122, a threaded extender 124, and a link 126. Alternative embodiments, may include a rack and pinion extender, a scissor extender, or any other type of linear actuator for adjusting the angle of the cutting platform relative to the base. In another embodiment of this invention, the actuator may be a motorized actuator.

Figure 18:
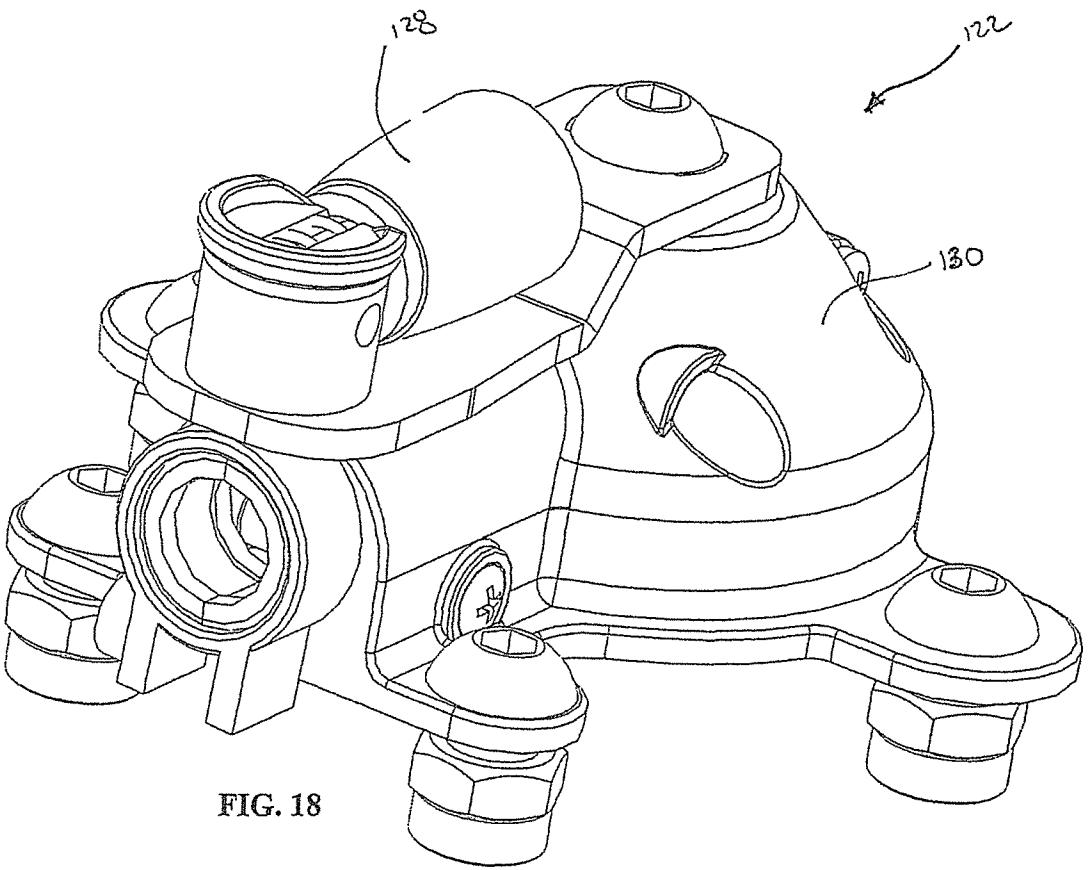
FIG. 18 shows a perspective view of a hand crank of the cutting tool of FIG. 12.
Figure 19:
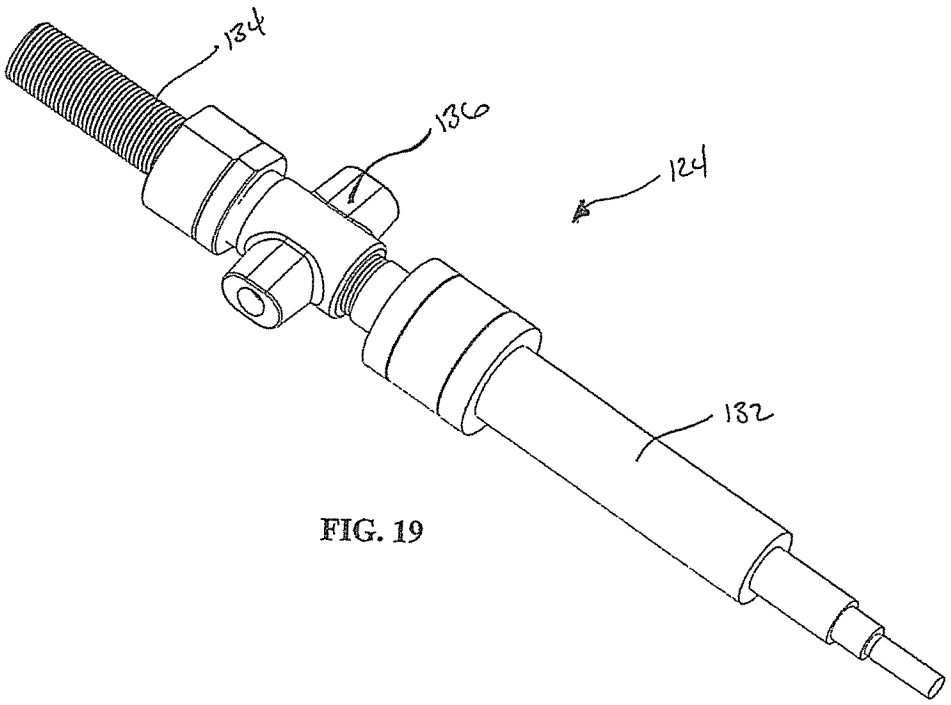
FIG. 19 shows a perspective view of a threaded extender of the cutting tool of FIG. 12.
Figure 20:
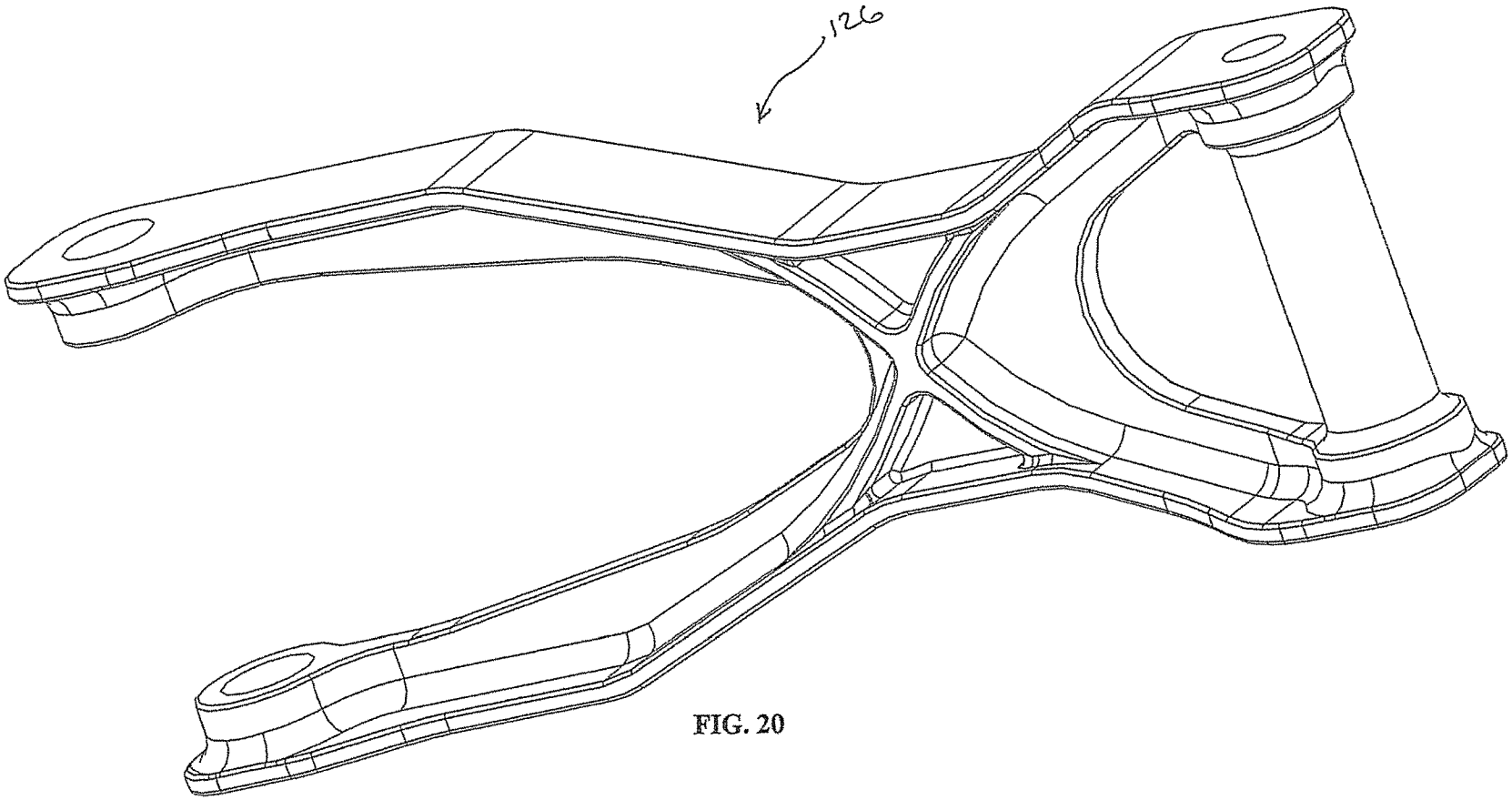
FIG. 20 shows a perspective view of a link of the cutting tool of FIG. 12.
Figure 21:
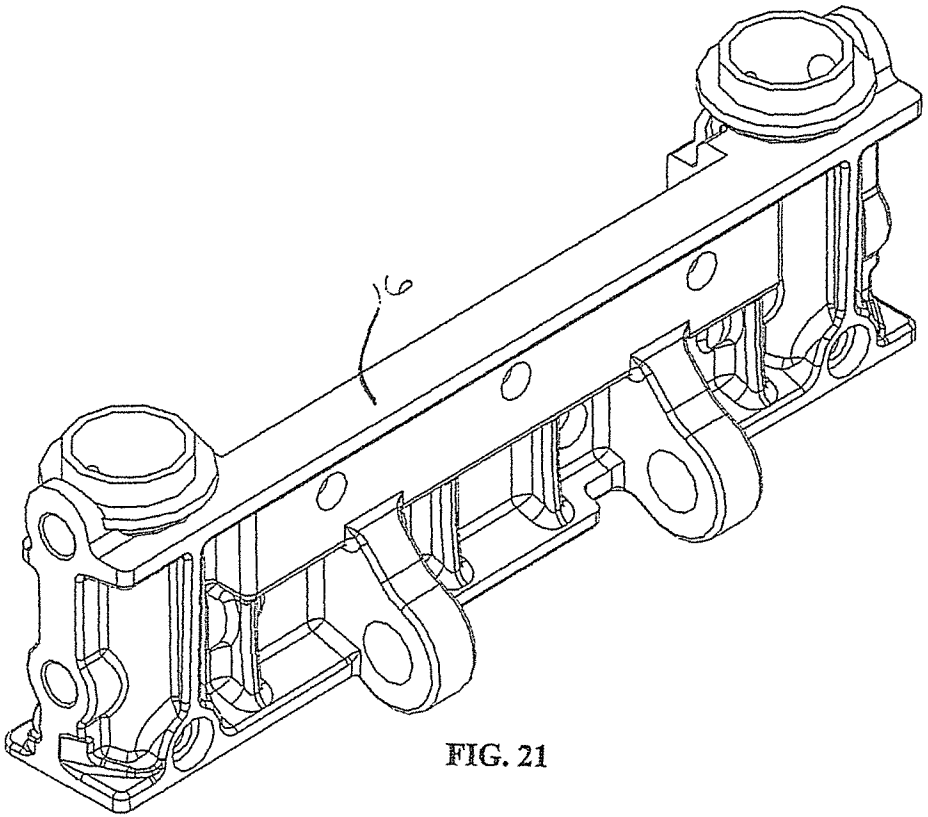
FIG. 21 shows a perspective view of a cutting platform of the cutting tool of FIG. 12.

FIGS. 18-20 show the components of the cutting platform actuator 120 separate from other components of the cutting tool 10. FIG. 18 shows the hand crank 122 according to an embodiment of this invention. The hand crank 122 comprises a handle 128 for rotating a bevel gear, not shown, positioned with a housing 130. The hand crank 122 may be operated to rotate and extend the threaded extender 124, shown in FIG. 19. The threaded extender 124 preferably includes a shaft 132, a threaded portion 134, and a yoke 136. The yoke 136 connects to the link 126, shown in FIG. 20. The link 126 connects to the cutting platform 16, shown in FIG. 21. In operation, turning the hand crank 122 rotates the bevel gear and in turn rotates the threaded extender 124. The yoke 136 with a threaded nut 138 is prevented from rotating due to a connection with the link 126 and the cutting platform 16. Rotation of the threaded portion 134 of the threaded extender forces the threaded nut 138 to move toward or away from the cutting platform, depending on the direction of rotation. Movement of the yoke 136 along the threaded portion sets the angle between the cutting platform 16 and the base 14. For example, FIG. 14 shows the position of the yoke 136 relative to the threaded extender 124 when the angle is set to 0°, a vertical cut. FIG. 16 shows the position of the yoke 136 relative to the threaded extender 124 when the angle is set to 45°.

FIGS. 22-33 show another embodiment of a cutting tool 210 of this invention. The cutting tool 210 is preferably capable of cutting building materials 212 at a plurality of angles including, but not limited to perpendicular, 30°, and 45°. The cutting tool 210 of this embodiment is preferably used to cut flexible building materials including, but not limited to, rubber or vinyl materials such as rubber baseboards which are commonly used in hospitals.

Figure 22:
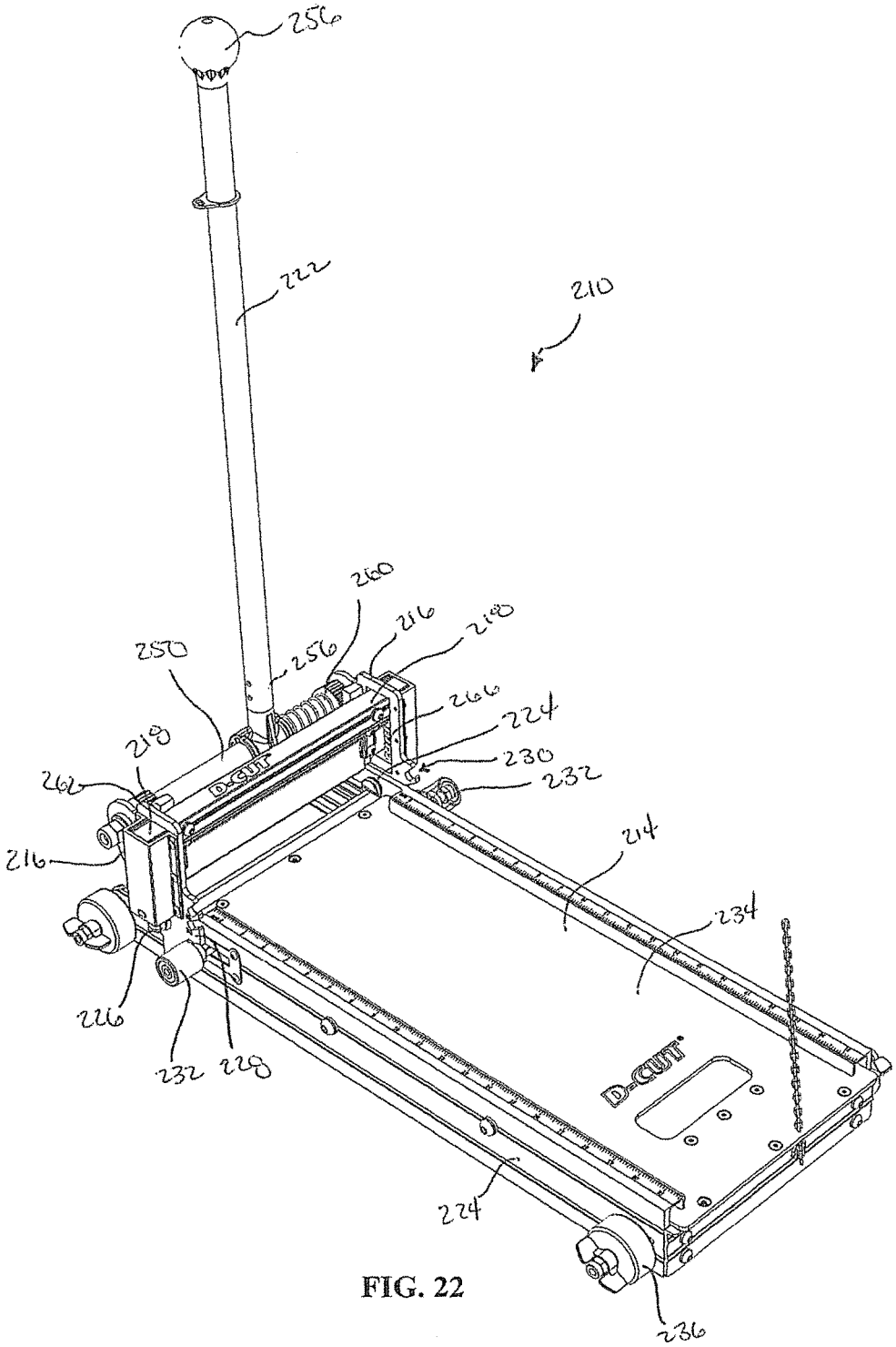
FIG. 22 shows a perspective view of another embodiment of the cutting tool of this invention in a starting position with a blade set perpendicular to a base.
Figure 23:
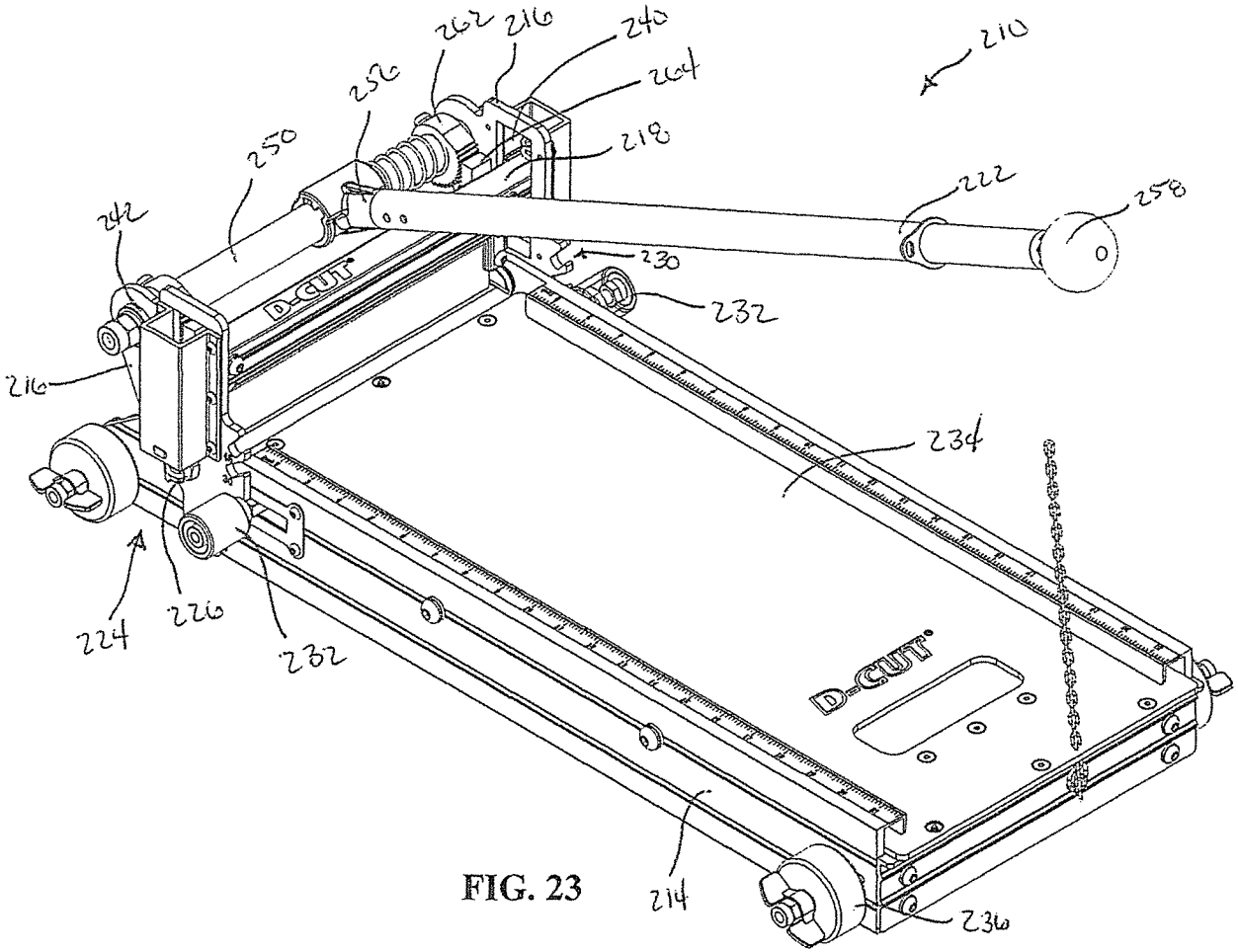
FIG. 23 shows a perspective view of the cutting tool of FIG. 22 in a final cutting position.

As shown in FIGS. 22-33, the cutting tool 210 of this embodiment includes a base 214, a pair of risers 216 extending generally perpendicular from the base 214, a blade holder 218 and a blade 220 positioned between the pair of risers 216, and a handle 222 for actuating the blade 220 from a starting position, shown in FIG. 22, to a final cutting position, shown in FIG. 23. The pair of risers 216 are preferably connected to the base 214 with an adjustable, lockable, pivotable connection 224 allowing the blade holder 218 and the blade 220 to be set at a plurality of angles to the base 214.

In an embodiment of the invention, the base 214 comprises a rectangular shape that provides stability for the cutting tool 210, however the base 114 is not limited to this shape and may comprise any shape that provides a stable base for the cutting tool 10. The base 214 may be formed of steel, aluminum, plastic, composites or another material with durable qualities capable of withstanding the force required to cut the building materials. The base 214 preferably includes a support surface 234 for accommodating the material 212 to be cut. In the embodiment of FIGS. 22-33, the base 214 includes a plurality of wheels 236 for moving the tool 210.

Figure 24:
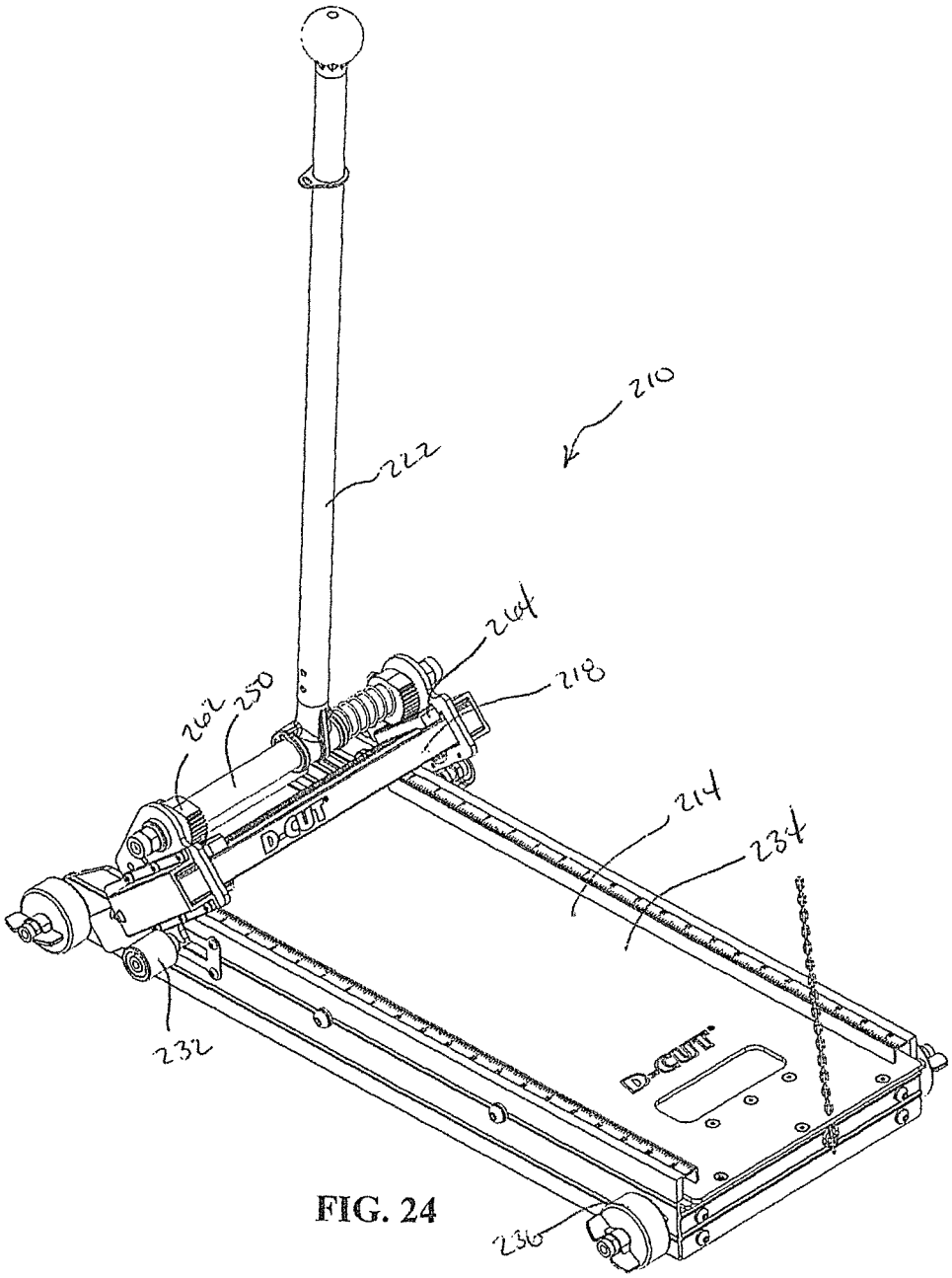
FIG. 24 shows a perspective view of the cutting tool of FIG. 22 in the starting position with the blade set to cut at a 45° angle.
Figure 25:
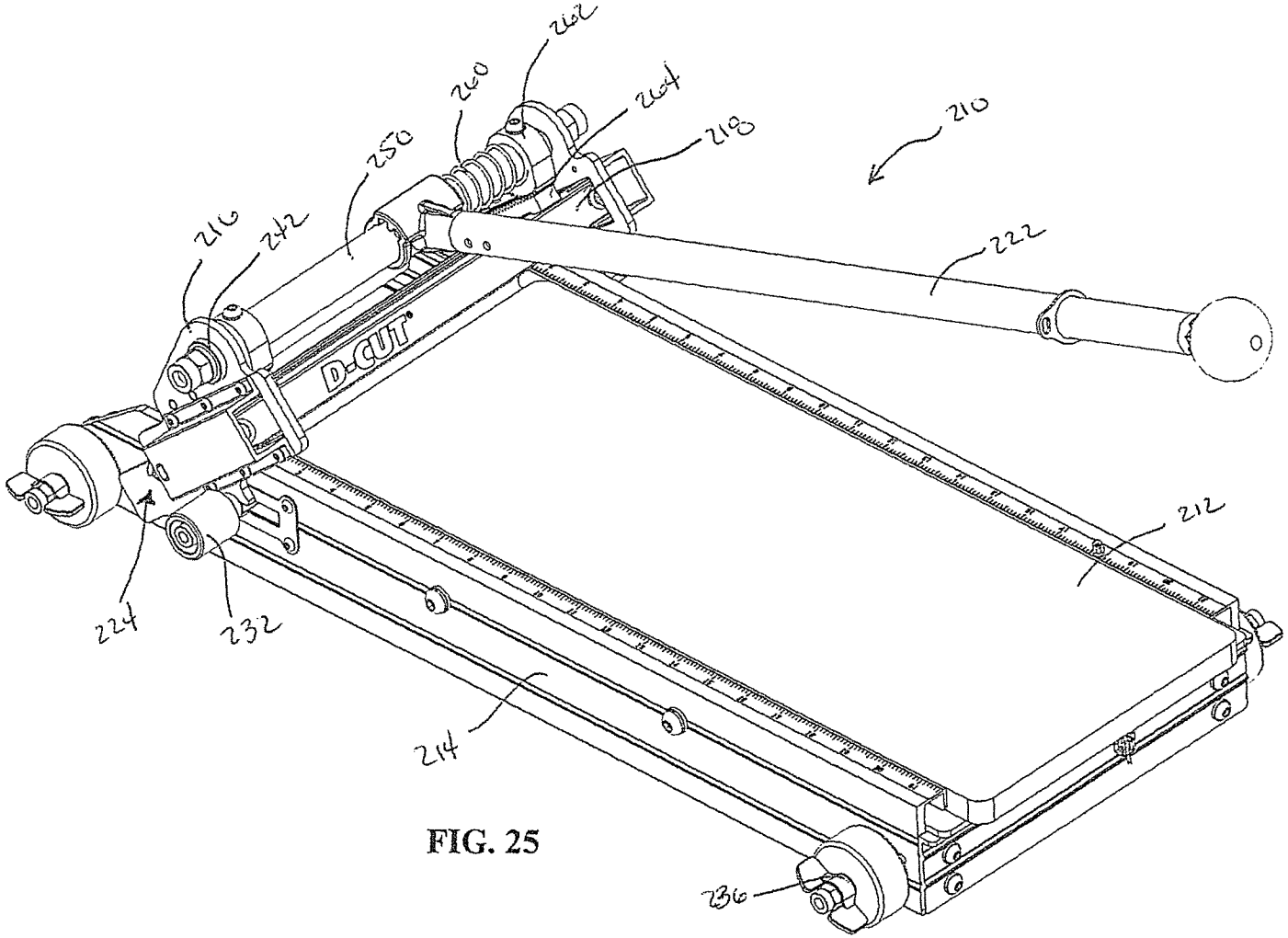
FIG. 25 shows a perspective view of the cutting tool of FIG. 24 in the final cutting position.
Figure 26:
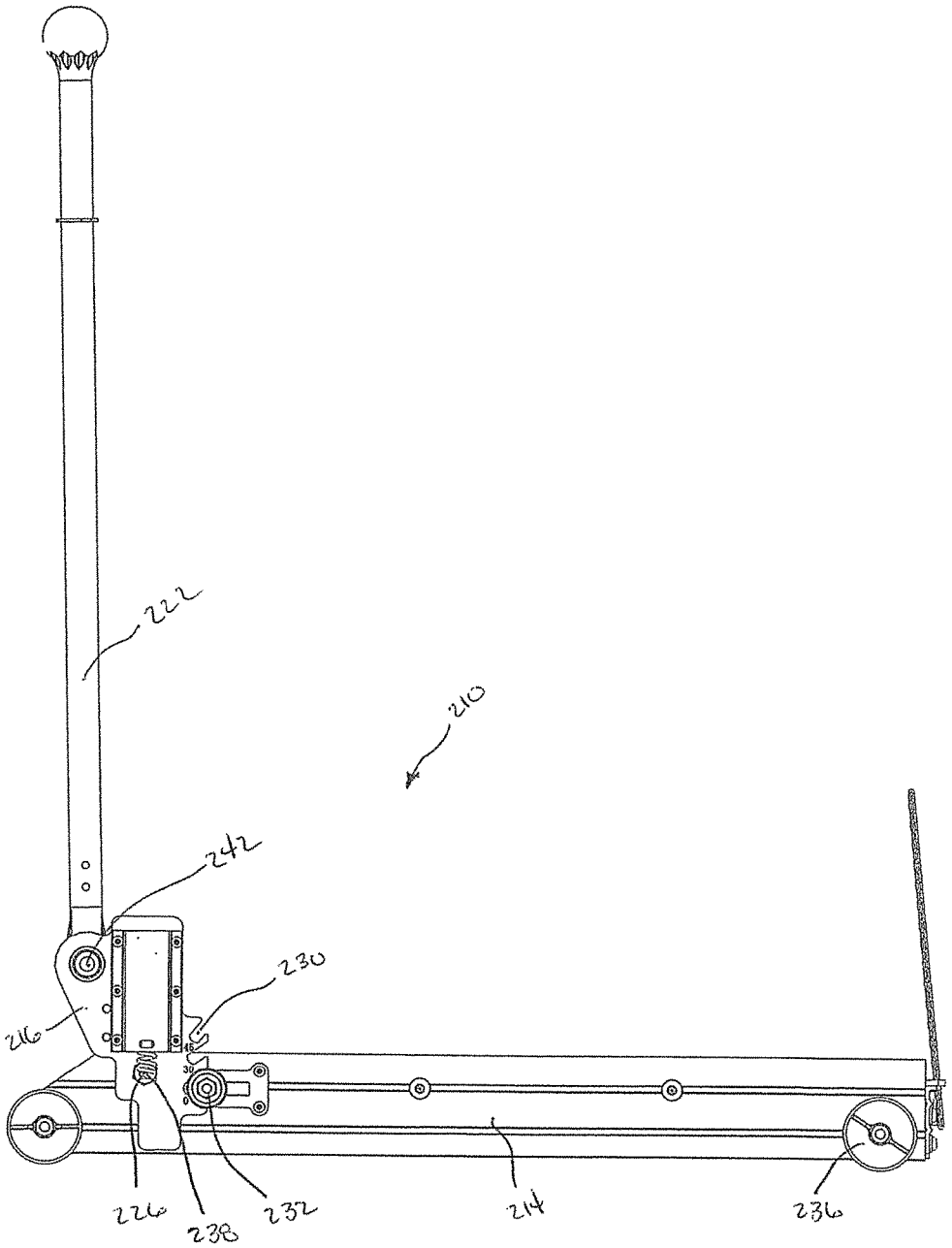
FIG. 26 shows a side view of the cutting tool of FIG. 22.

In a preferred embodiment of this invention, the risers 216, the blade holder 218 and the handle 222 are connected to the base 214 with the adjustable, lockable, pivotable connection 224 allowing the blade 220 to be set at a plurality of angles to the base 214 to cut materials at a plurality of angles including 90°, 45°, 30°, and 22.5°. For example, FIGS. 22 and 23 show the risers 216, the blade holder 218, and the blade 220 aligned with the base 214 for a perpendicular cut. Please note the perpendicular cut is identified as 0° on the risers 216 in the figures. FIGS. 24 and 25 show the risers 216, the blade holder 218, and the blade 220 aligned with the base 214 for a 45° cut. In the embodiment of FIGS. 22-25 the blade 220 can be set at one of three angles to the base 214 including a perpendicular cut, a 45° cut, a 30° cut and a 22.5° cut. However, the cutting tool 210 of this invention can be designed to be set to any number of angles including angles ranging from 0° to approaching 180°. In an embodiment of this invention, the blade 220 is not set at an angle to the base 214 equal to a desired cut angle. Due to properties of the flexible building material the blade 220 may be set to a first angle to the base 214 which will result in a cut through the flexible building material at a second angle. In an embodiment of this invention, the blade 220 may be set at an angle greater than 47° to make a 45° angle cut. For example, for flexible materials, the first angle is set at a 50° angle to cut the flexible building material at a 45° angle, a commonly desired cut. In other embodiments, the first angle may range from 47° to 52° to make a 45° cut. In other embodiments, the first angle may range from 31° to 34° to make a 30° cut. It should be understood that the preceding are examples and that a person having ordinary skill in the art may use alternative first angles to obtain desired second angles.

Figure 27:
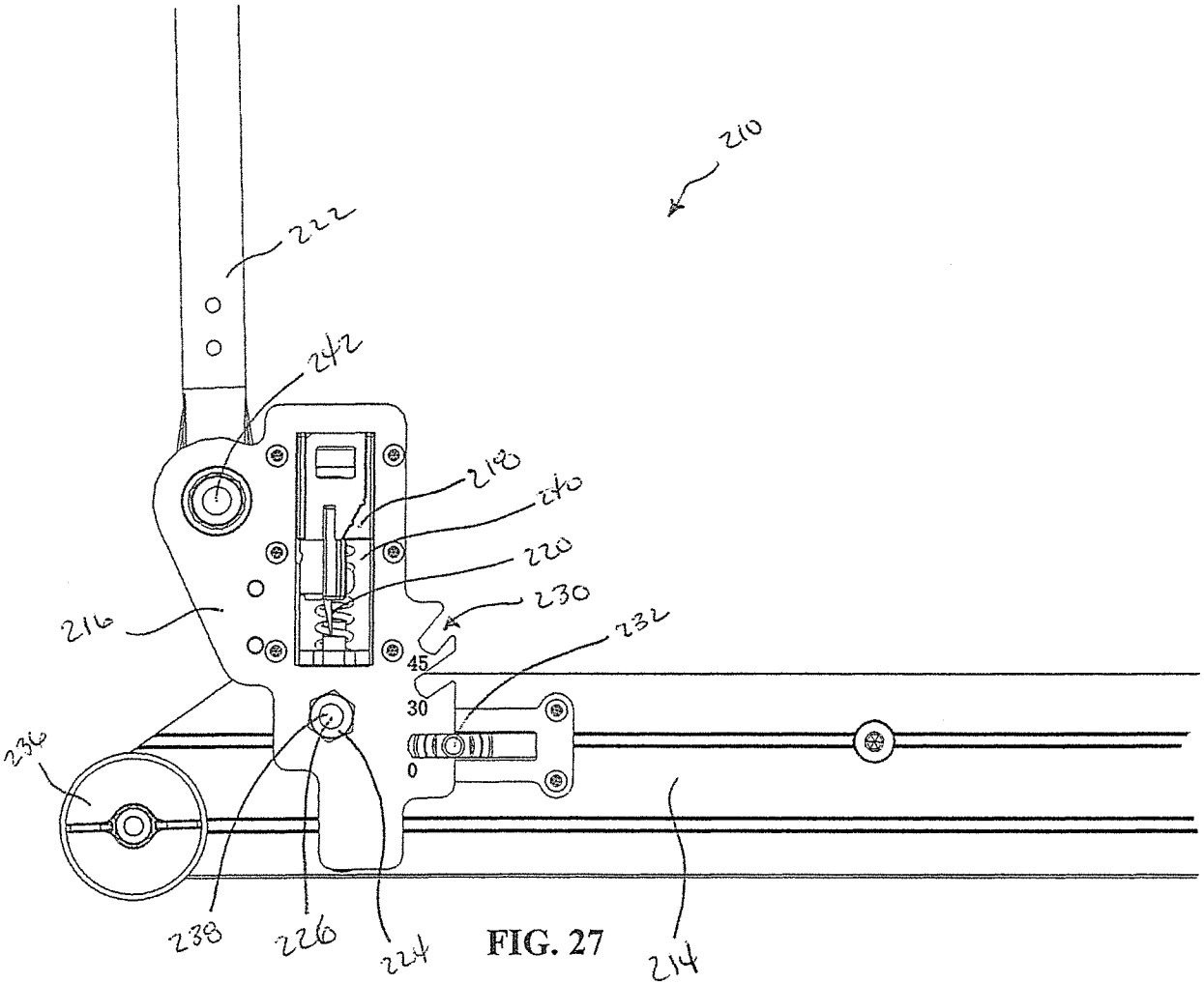
FIG. 27 shows a close-up side view of the cutting tool of FIG. 22 with a riser cover and a latch grip removed.
Figure 28:
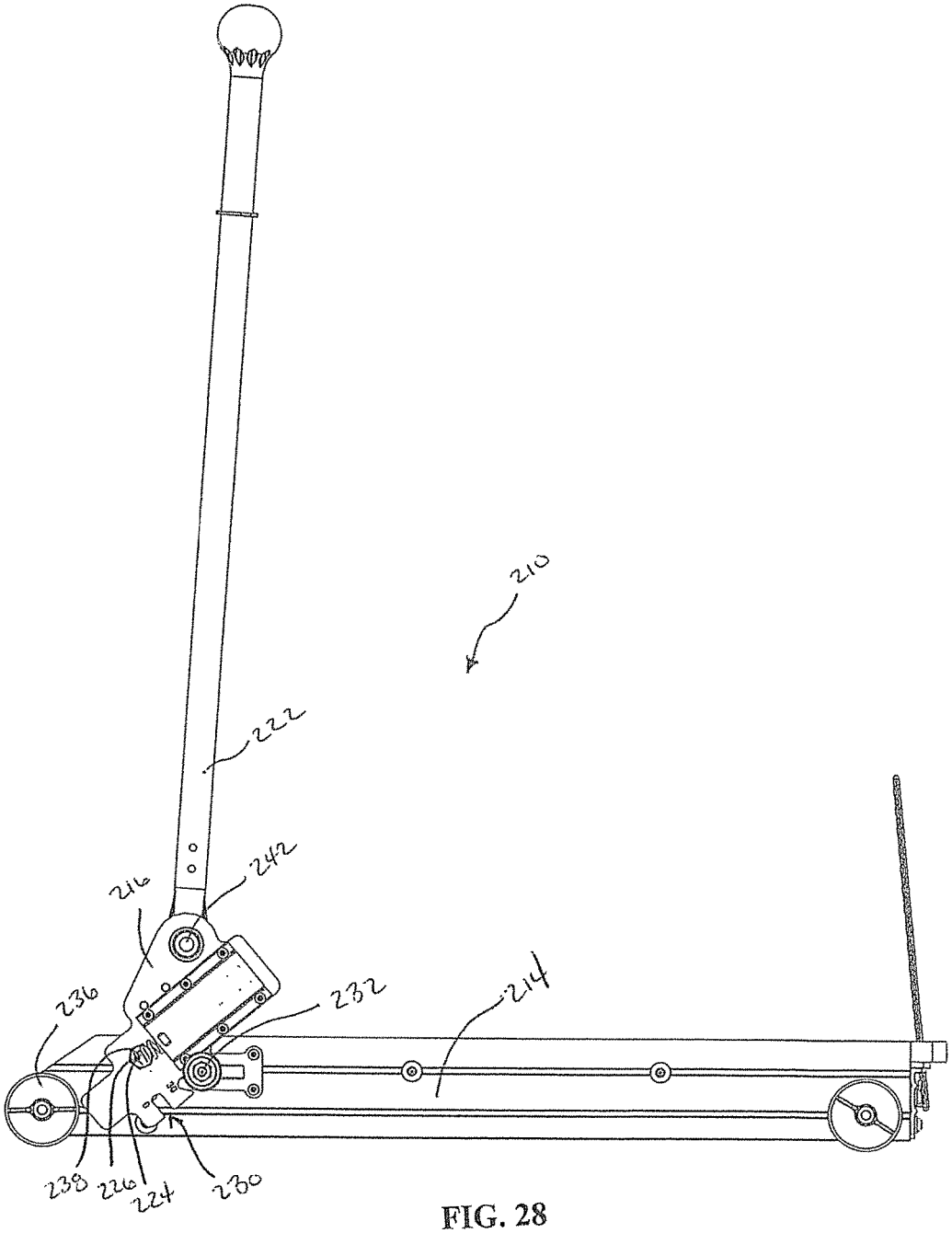
FIG. 28 shows a side view of the cutting tool of FIG. 24.
Figure 29:
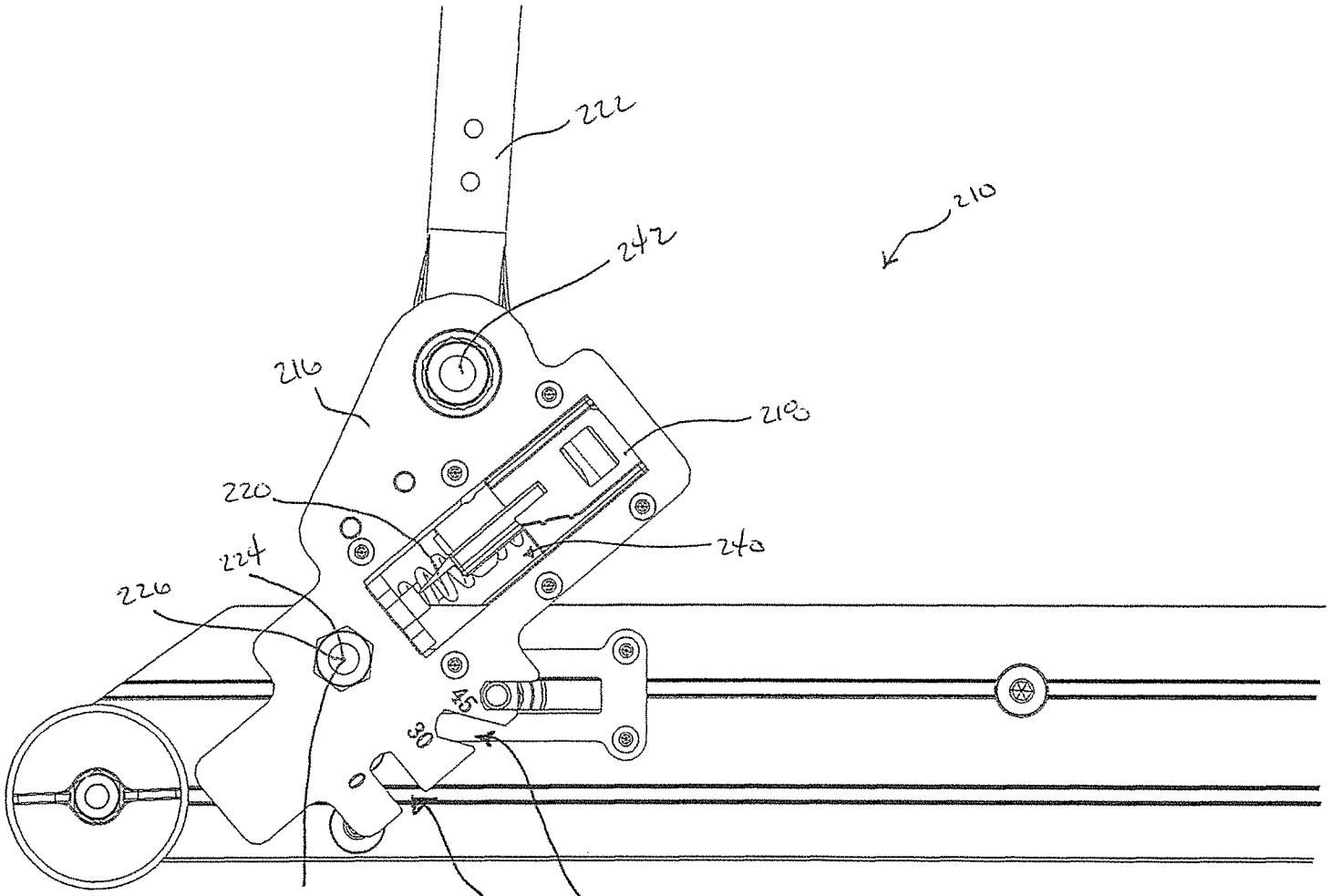
FIG. 29 shows a close-up side view of the cutting tool of FIG. 24 with a riser cover and a latch grip removed.
Figure 30:
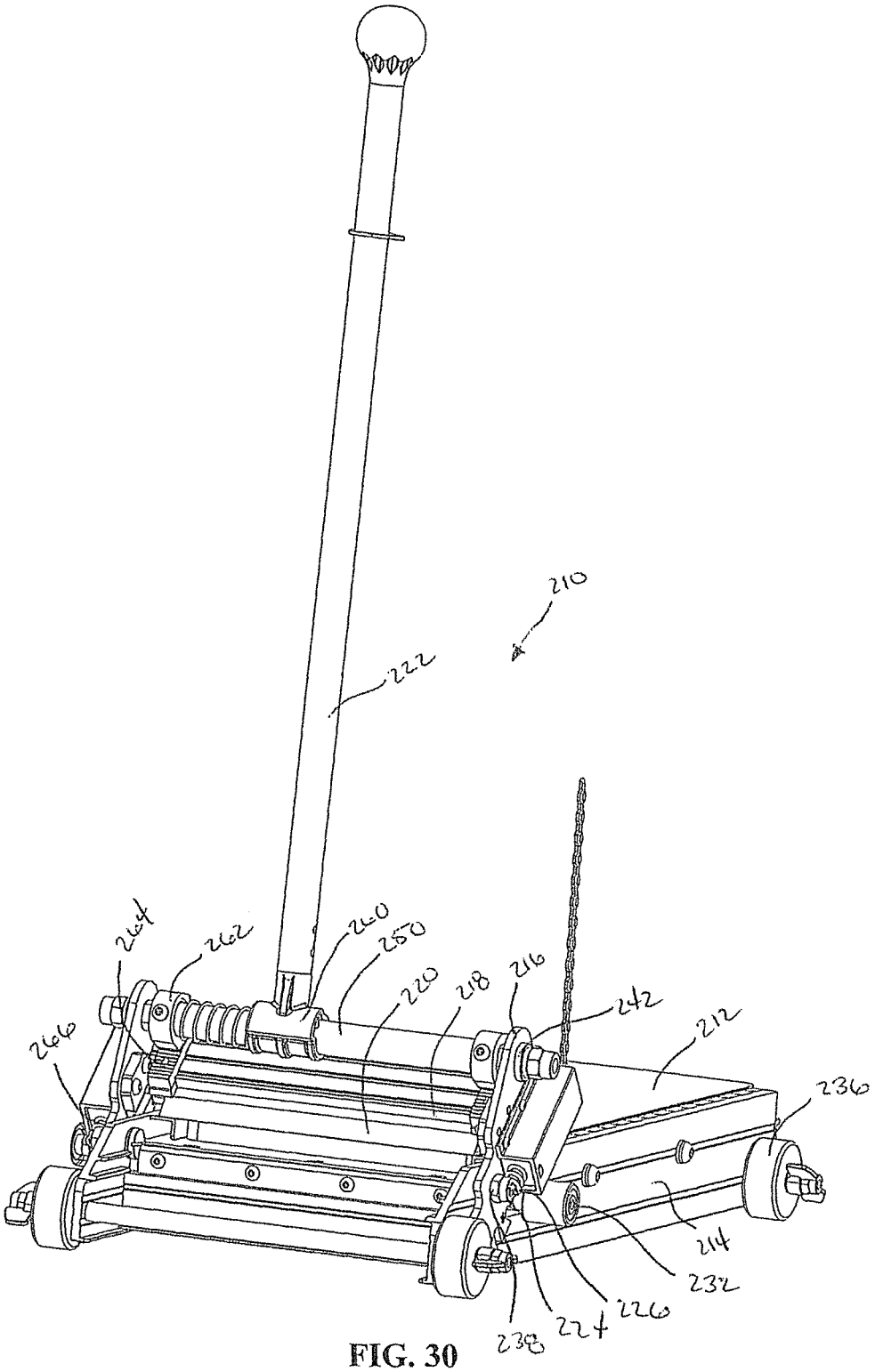
FIG. 30 shows a rear perspective view of the cutting tool of FIG. 22 in the starting position with the blade set to cut at a 45° angle.
Figure 31:
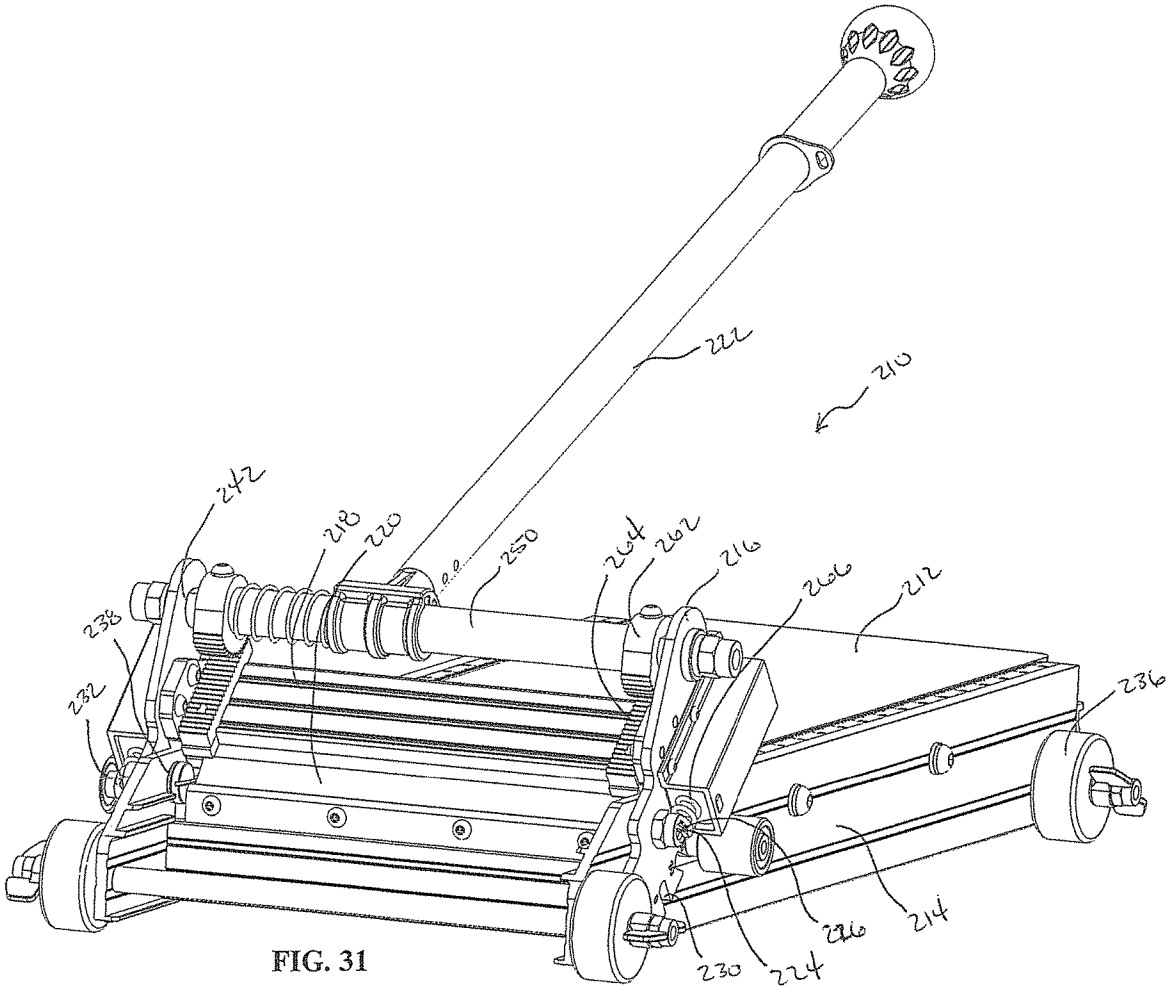
FIG. 31 shows a rear perspective view of the cutting tool of FIG. 22 in the final cutting position with the blade set to cut at a 45° angle.
Figure 32:
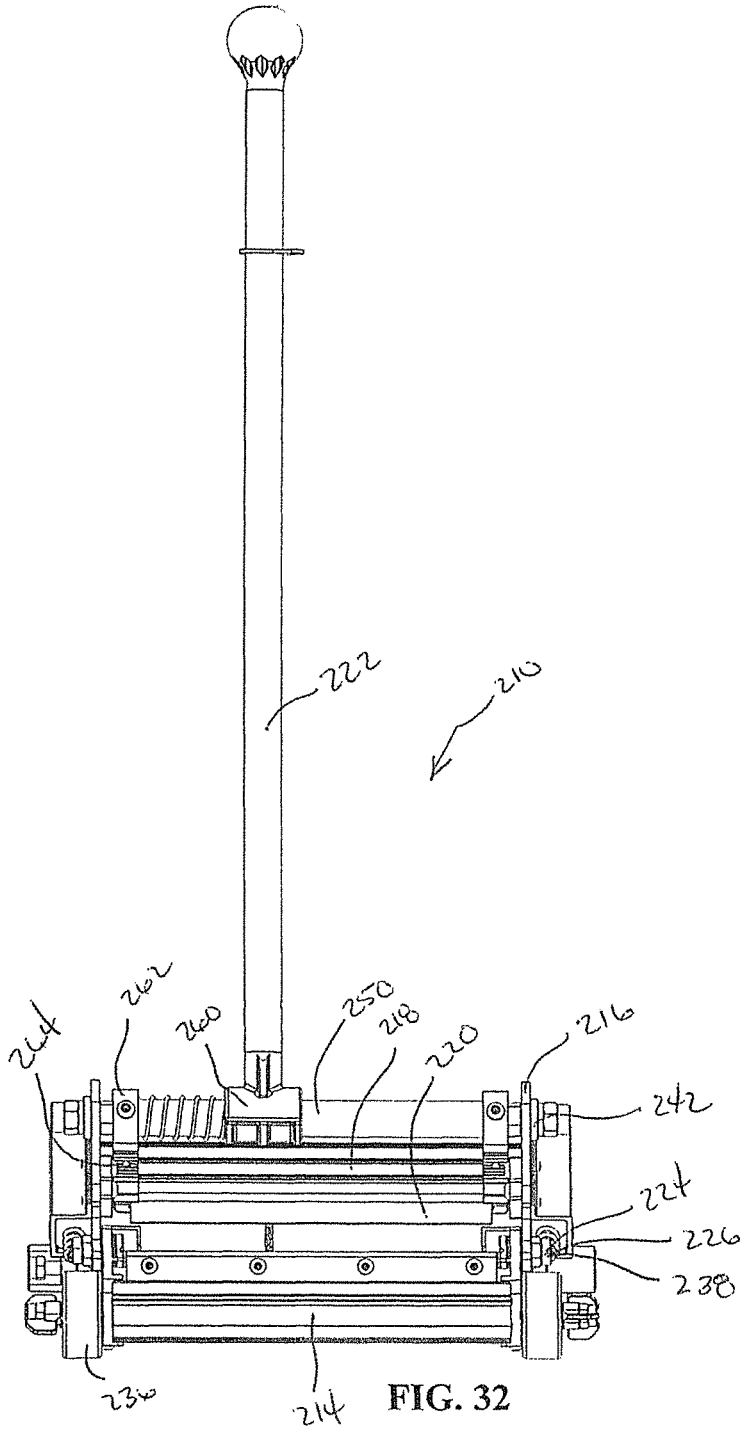
FIG. 32 shows a rear view of the cutting tool of FIG. 30.
Figure 33:
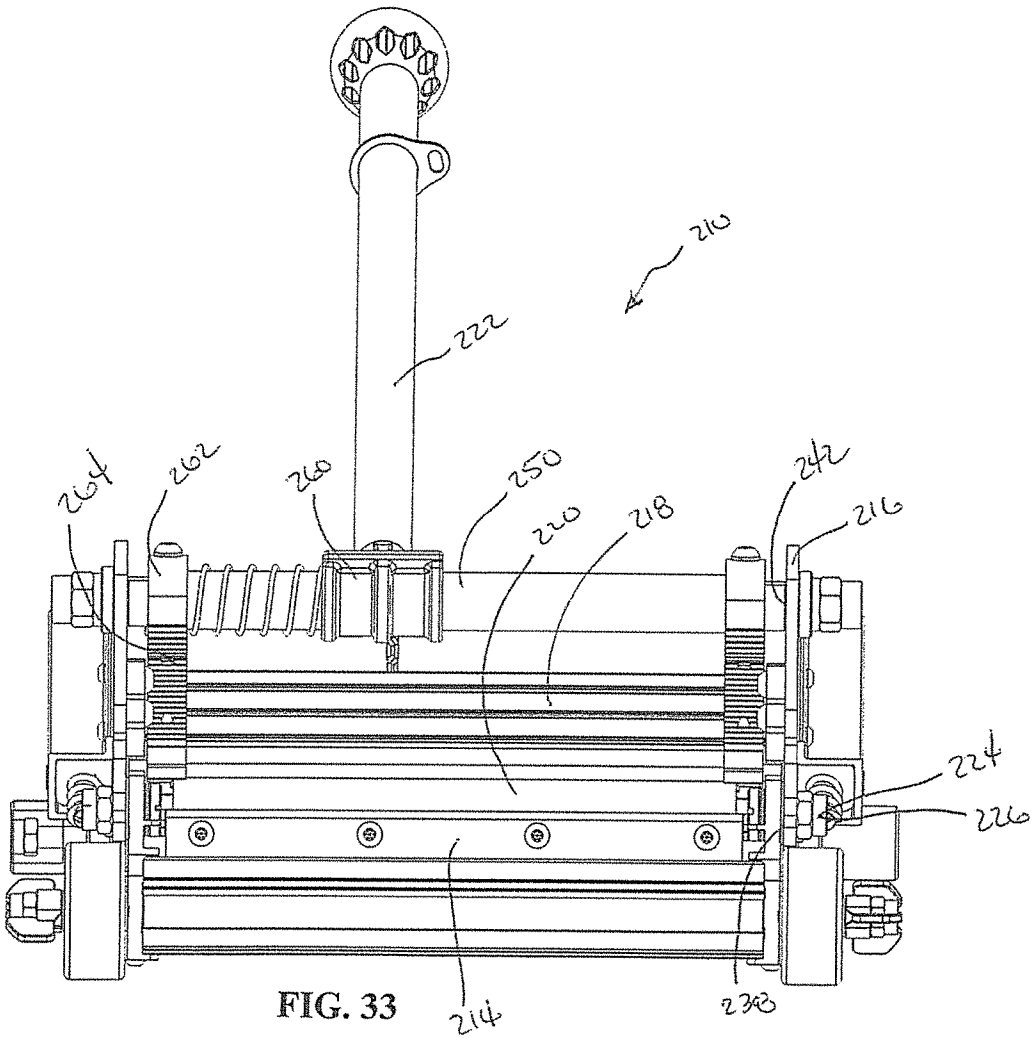
FIG. 33 shows a rear view of the cutting tool of FIG. 31.
Figure 34:
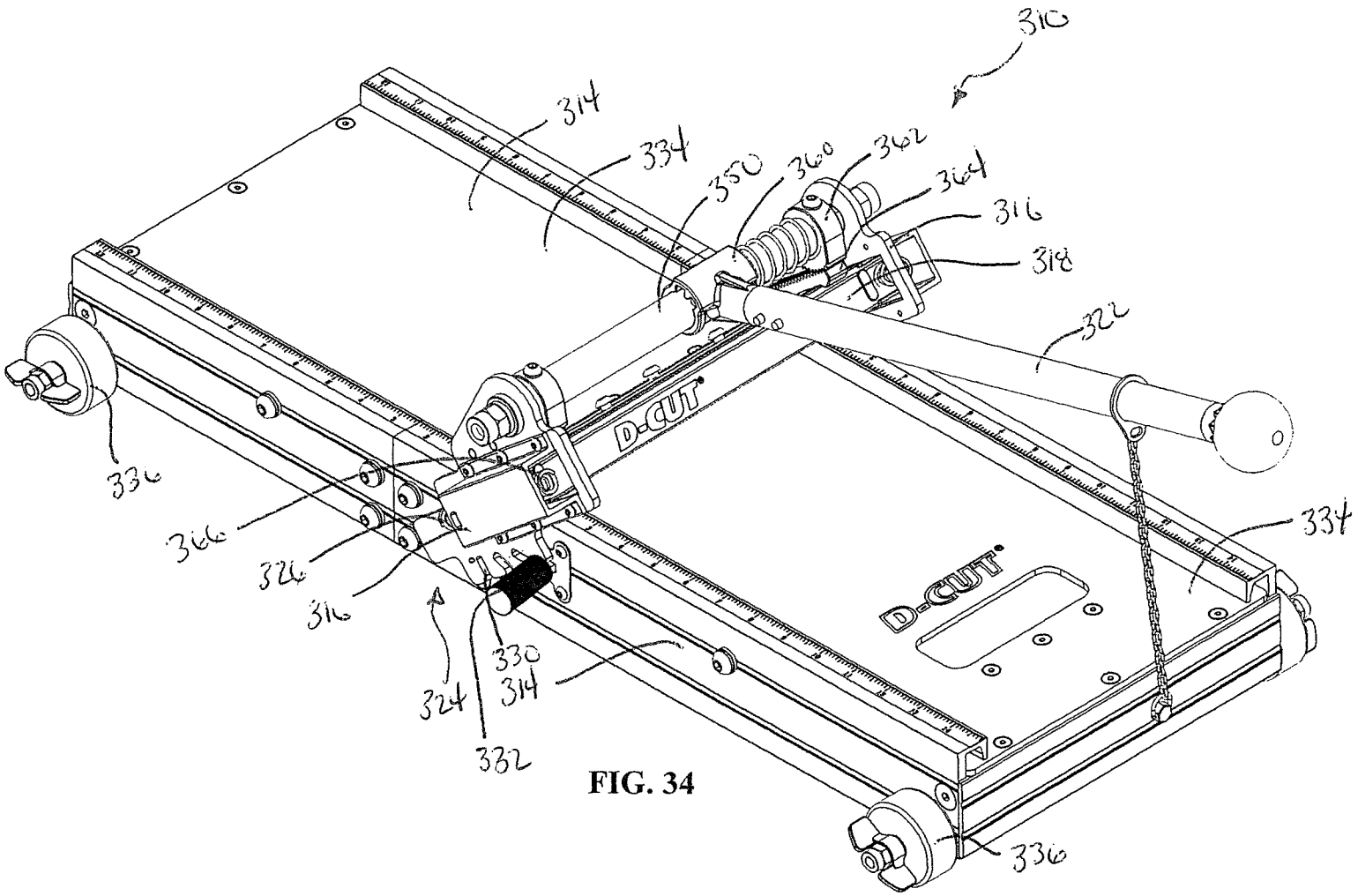
FIG. 34 shows a perspective view of another embodiment of the cutting tool of this invention with a cutting platform centered on a base and a working table.

FIGS. 27 and 29 show a close-up side view of the cutting tool 210 with a riser cover and a latch grip removed to better show the connection 224 and the riser 216 according to an embodiment of this invention. In this embodiment, the risers 216 each include an axle receiver 238, a blade holder guide slot 240, a handle axle receiver 242, and a plurality of slots 230. As shown in this embodiment, the riser 216 is connected to the base 214 with an axle 226 extending through the axle receiver 238 to provide the rotatable connection 224 and locked in a position with a latch 232 that is slid into one of the plurality of slots 230. To set the blade 220 to cut at an angle, the latch 232 disengaged from the slot 230, the riser 216 and blade holder 218 are rotated about the axle 226 to a desired angle and the latch 232 is re-engaged with a new slot 230. For example, from the perpendicular angle shown in FIG. 27 to the 45° angle shown in FIG. 29. Preferably, the latch 232 is biased towards engagement with the slot 230 by a spring, not shown, or by some other device that prevents the latch from disengaging from the slot while the material is being cut. Preferably, the cutting tool 210 is further secured with a lock, a catch or another similar device that prevents the latch 232 from disengaging from the slot 230 unintentionally. In an embodiment of this invention, due to deflection of the flexible building material, the slot 230 may not be set at the same angle as the desired cut angle. For example, in an embodiment, the slot 230 may be set to result in the blade being set at a 50° angle to the base and resulting in a 45° angle cut through the building material. In another example, the slot may be set at a 32° angle to make a 30° cut.

In an embodiment of this invention, the cutting tool 210 includes a blade stop on the base 214. The blade stop is preferably manufactured of a soft material, such as but not limited to nylon, that causes minimal damage to an edge of the blade 220. Preferably, the blade stop is removably connected to the base to allow for replacement as the blade stop wears.

As shown in FIGS. 22-33, this invention includes the handle 222 with a proximate end 256 and a distal end 258. The proximate end 256 is attached to a handle axle 250 which extends between the two risers 216. The handle axle 250 is rotably connected to the risers 216 with a shaft extending through the handle axle receiver 242. In a preferred embodiment, the proximate end 256 of the handle 222 is connected to the handle axle 250 with an adjustable connection 260. The adjustable connection 260 allows the handle 222 to be set in at least two positions to compensate for the angle of cutting, allowing the handle 222 to rotate fully from the starting position to the final cutting position and to prevent the handle 222 from contacting the base 214. The distal end 258 of the handle 222 preferably includes a hand grip for the user to manually grab or engage. In an alternative embodiment, the handle 222 may be extendible to provide a longer lever for cutting the material 212.

As best shown in FIGS. 30-33, the blade holder 218 is positioned between the risers 216 with a portion of each end of the blade holder 218 extending through the blade holder guide slot 240 in the rises 216, where the guide slot 240 provides a straight path for the blade holder 18 to move from the starting position to the final cutting position. The blade holder 218 may be formed of a material such as steel or similar rigid material. The blade 220 is preferably formed of steel or another material capable of repeatedly cutting all thicknesses and compositions of material 212. In a preferred embodiment, the blade 220 is attached to the blade holder 218 with a removable connection allowing the blade 220 to be removed from the blade holder for repairs, sharpening, or replacement. According to a preferred embodiment, the blade holder 218 and blade 220 are biased upward into the open position by a spring 266.

In a preferred embodiment of this invention, the handle axle 250 further includes a gear 262 which engages with a rack 264 positioned on the blade holder 218. In operation, the cutting tool 210 of this invention starts in the starting position, as shown for example in FIG. 30. In the starting position, the blade holder 218 and the blade 220 are spaced from the base providing an opening between the blade 220 and the base 214. The material 212 to be cut is placed onto the support surface 226 and through the opening formed between the blade 218 and the base 214. To cut the material 212, the handle 222 is lowered, rotating the gear 262 positioned on the handle axle 250. Teeth of the rotating gear 262 engage with teeth on the rack 264 causing the blade holder 218 to move downward through the material 212 until the blade 220 contacts the blade stop of the base 214, the final cutting position, thereby severing the material 212. The resulting cut is optimally free of splinters and a resulting cut end of the material is otherwise clean and straight.

FIGS. 34-37 show another embodiment of a cutting tool 310 of this invention. The cutting tool 310 is preferably capable of cutting building materials at a plurality of angles including, but not limited to, 22.5°, 45°, 90°, 135°, and 157.5°. The cutting tool 310 of this embodiment provides support for the building material whether the desired cut is an acute angle or a complementary obtuse angle. The cutting tool 310 may also be used to cut flexible building materials including, but not limited to, rubber or vinyl materials such as rubber baseboards which are commonly used in hospitals.

As shown in FIGS. 34-37, the cutting tool 310 of this embodiment includes a base 314, a pair of risers 316 extending generally perpendicular from the base 314 approximately at a center of the base 314. As shown, a blade holder 318 and a blade 320 are positioned between the pair of risers 316. The cutting tool 310 further includes a handle 322 for actuating the blade 320 from a starting position to a final cutting position. The pair of risers 316 are preferably connected to the base 314 with an adjustable, lockable, pivotable connection 324 allowing the blade holder 318 and the blade 320 to be set at a plurality of angles to the base 314.

In an embodiment of the invention, the base 314 comprises a rectangular shape that provides stability for the cutting tool 310, however the base 314 is not limited to this shape and may comprise any shape that provides a stable base for the cutting tool 310. The base 314 may be formed of steel, aluminum, plastic, composites or another material with durable qualities capable of withstanding the force required to cut the building materials. The base 314 preferably includes a support surface 334 for accommodating the material to be cut. In this embodiment, the base 314 includes two support surfaces 334 with a first support surface on one side of the risers 316 and another on the other side of the risers 316. Alternatively, the cutting tool 310 may include a single support surface. In the embodiment of FIGS. 34-37, the base 314 further includes a plurality of wheels 336 for moving the tool 310.

In a preferred embodiment of this invention, the risers 316, the blade holder 318 and the handle 322 are connected near a center of the base 314 with the adjustable, lockable, pivotable connection 324 allowing the blade 320 to be set at a plurality of angles to the base 314 to cut materials at a plurality of angles including 90°, 45°, 22.5°, 135°, and 157.5°. Please note the perpendicular cut is identified as 0° on the risers 316 in the figures. FIGS. 34-37 show the risers 316, the blade holder 318, and the blade 320 aligned with the base 314 for a 45° cut. However, the cutting tool 310 of this invention can be designed to be set to any number of angles including angles ranging from 0° to approaching 180°.

By positioning the risers 316, the blade holder 318, and the blade 320 near the center of the base 314, a user may set the blade 320 at an angle and cut either the selected angle or a complimentary angle while supporting the desired cut piece on the right side or left side of the base 314 and the support surface 334. In other embodiments where the risers 316, the blade holder 318 and the blade 320 are positioned on one end of the base 314 and the support surface 334, the complimentary angle could be cut by flipping over the material to be cut. However, when the material to be cut has a non-flat profile, the flipped-over material may move or rock during the cutting process resulting in an improper cut. Furthermore, cutting the material on its face, rather than back, may damage the face of the material.

Figure 35:
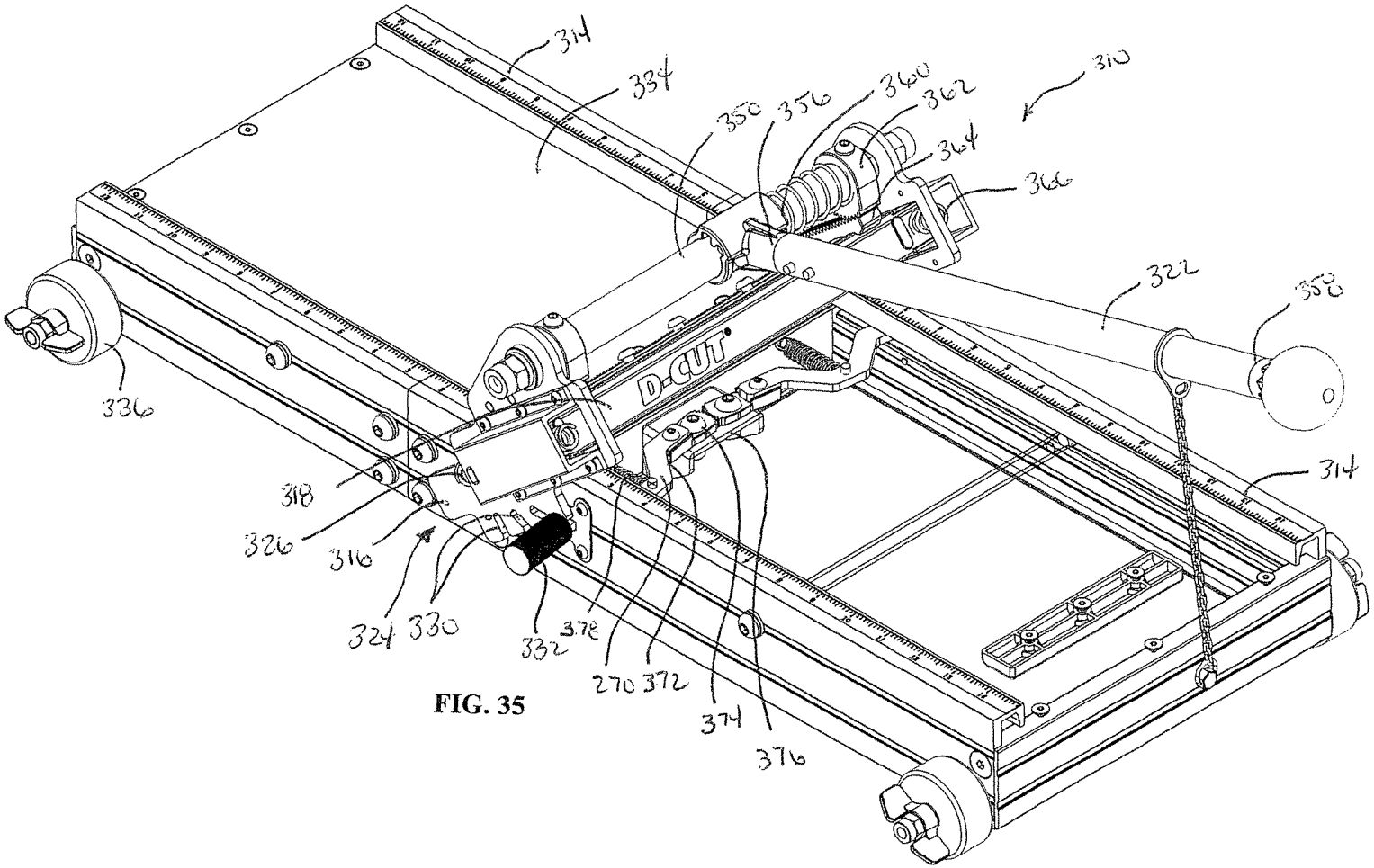
FIG. 35 shows a perspective view of the cutting tool of FIG. 34 with a portion of the working table removed.
Figure 36:
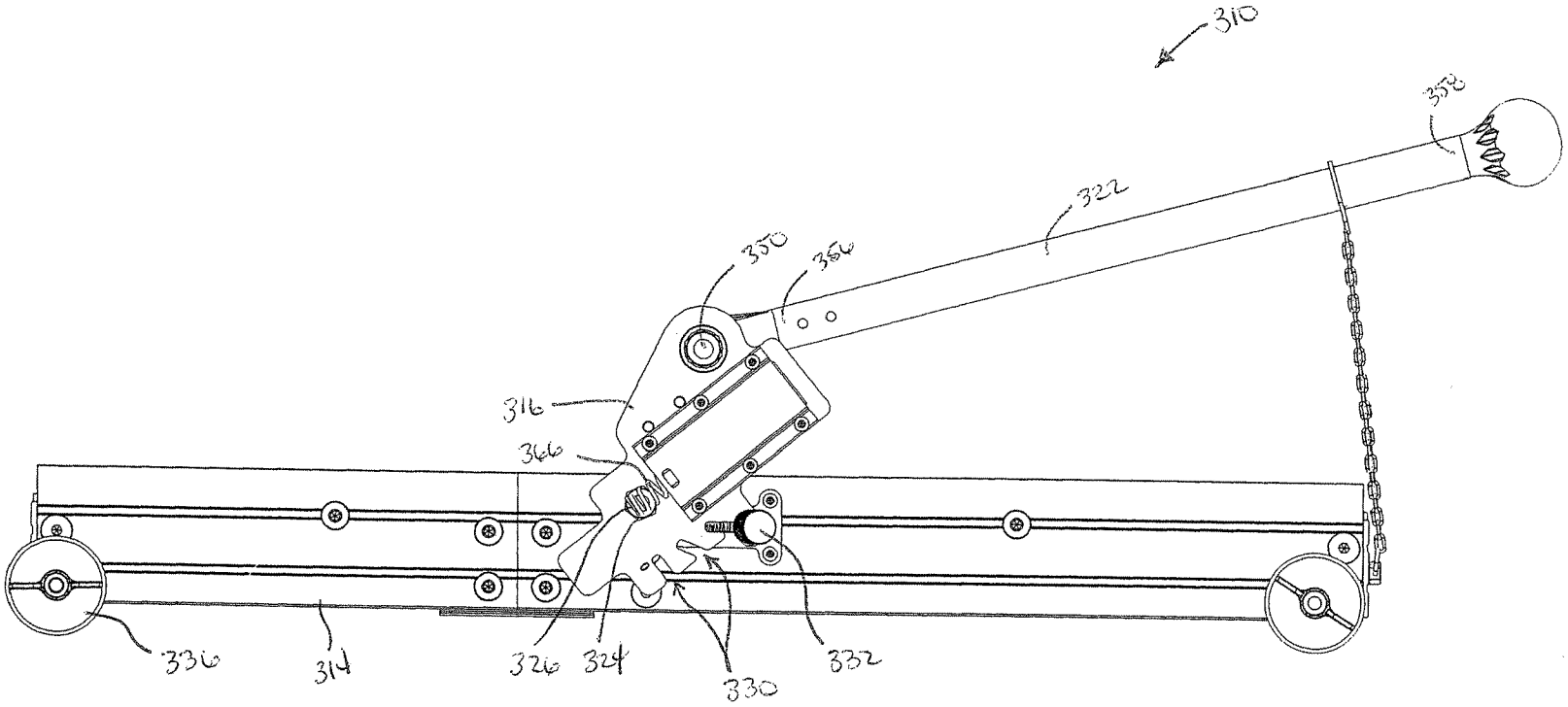
FIG. 36 shows a side view of the cutting tool of FIG. 34.

In this embodiment, the adjustable, lockable, pivotable connection 324 is similar to the connection described in connection with FIGS. 27 and 29. In this embodiment, the risers 316 each include an axle receiver, a blade holder guide slot, a handle axle receiver, and a plurality of slots 330 for setting an angle of the risers 316 relative to the base 314. As shown in FIG. 36, the riser 316 is connected to the base 314 with a riser axle 326 extending through the axle receiver to provide the rotatable connection 324 and locked in a position with a latch 332 that is slid into one of the plurality of slots 330. To set the blade 320 to cut at an angle, the latch 332 is disengaged from the slot 330, the riser 316 and blade holder 318 are rotated about the riser axle 326 to a desired angle and the latch 332 is re-engaged with a new slot 330. In a preferred embodiment, as shown in FIG. 35 with the support surface 334 removed, the latch 332 is connected to the latch on the other side of the cutting tool 310 by a dual-action latch mechanism 270. The dual action latch mechanism 270 allows a user to move one latch 332 and automatically move the second latch 332 on the other side of the cutting tool 310. In this embodiment, the dual-action latch mechanism 270 includes a pair of latch connectors 372, a pair of gears 374, a bracket 376, and a pair of springs 378. Each latch connectors 372 extends from a respective latch 332 and connect to one of the gears 374 mounted on the bracket 376. The pair of gears 374 mesh to force both latches to move, engage or disengage, when the user moves one of the latches 332. The latch 332 is biased towards engagement with the slot 330 by the springs 278 to prevent the latches 332 from disengaging from the slot 330 while the material is being cut. Preferably, the cutting tool 310 is further secured with a lock, a catch or another similar device that prevents the latch 332 from disengaging from the slot 330 unintentionally.

In an embodiment of this invention, the cutting tool 310 of FIGS. 34-37 may be designed to cut through slightly flexible materials including, but not limited to, rubber and vinyl materials. Due to flex in the material as the blade is pressed into the flexible building material, the blade 320 may not be set at the same angle as the desired cut angle. Instead, the blade 320 may be set to a first angle to the base 314 which will result in a cut through the flexible building material at a second angle. In an embodiment of this invention, the blade 320 may be set at an angle greater than 46° to make a 45° angle cut. For example, for flexible materials, the slot 330 is set at an angle so that the first angle between the blade 320 and the base 314 is set at a 50° angle to cut the flexible building material at a 45° angle, a commonly desired cut. In other embodiments, the first angle may range from 46° to 52° to make a 45° cut (the second angle). In other embodiments, the first angle may range from 23° to 27° to make a 22.5° cut. It should be understood that the preceding are examples and that a person having ordinary skill in the art may use alternative first angles to obtain desired second angles.

In an embodiment of this invention, the cutting tool 310 includes a blade stop on the base 314. The blade stop is preferably manufactured of a soft material, such as but not limited to nylon, that results in minimal damage to an edge of the blade 320. Preferably, the blade stop is removably connected to the base to allow for replacement as the blade stop wears.

This invention may further include an adjustable handle 322 including a proximate end 356 and a distal end 358. The proximate end 356 is attached to a handle axle 350 which extends between the two risers 316. The handle axle 350 is rotably connected to the risers 316 with a shaft extending through the handle axle receiver. In a preferred embodiment, the proximate end 356 of the handle 322 is connected to the handle axle 350 with an adjustable connection 360. The adjustable connection 360 allows the handle 322 to be set in at least two positions to compensate for the angle of cutting, allowing the handle 322 to rotate fully from the starting position to the final cutting position and to prevent the handle 322 from contacting the base 314. The distal end 358 of the handle 322 preferably includes a hand grip for the user to manually grab or engage. In another embodiment, the handle 322 may be extendible to provide a longer lever for cutting the building material.

In the embodiment of FIGS. 34-37, the blade holder 318 is positioned between the risers 316 with a portion of each end of the blade holder 318 extending through a blade holder guide slot in the rises 316, where the blade holder guide slot 340 provides a straight path for the blade holder 318 to move from the starting position to the final cutting position. The blade holder 318 may be formed of a material such as steel or similar rigid material. The blade 320 is preferably formed of steel or another material capable of repeatedly cutting all thicknesses and compositions of material. In a preferred embodiment, the blade 320 is attached to the blade holder 318 with a removable connection allowing the blade 320 to be removed from the blade holder for repairs, sharpening, or replacement. According to a preferred embodiment, the blade holder 318 and blade 320 are biased upward into the open position by a spring 366.

Figure 37:
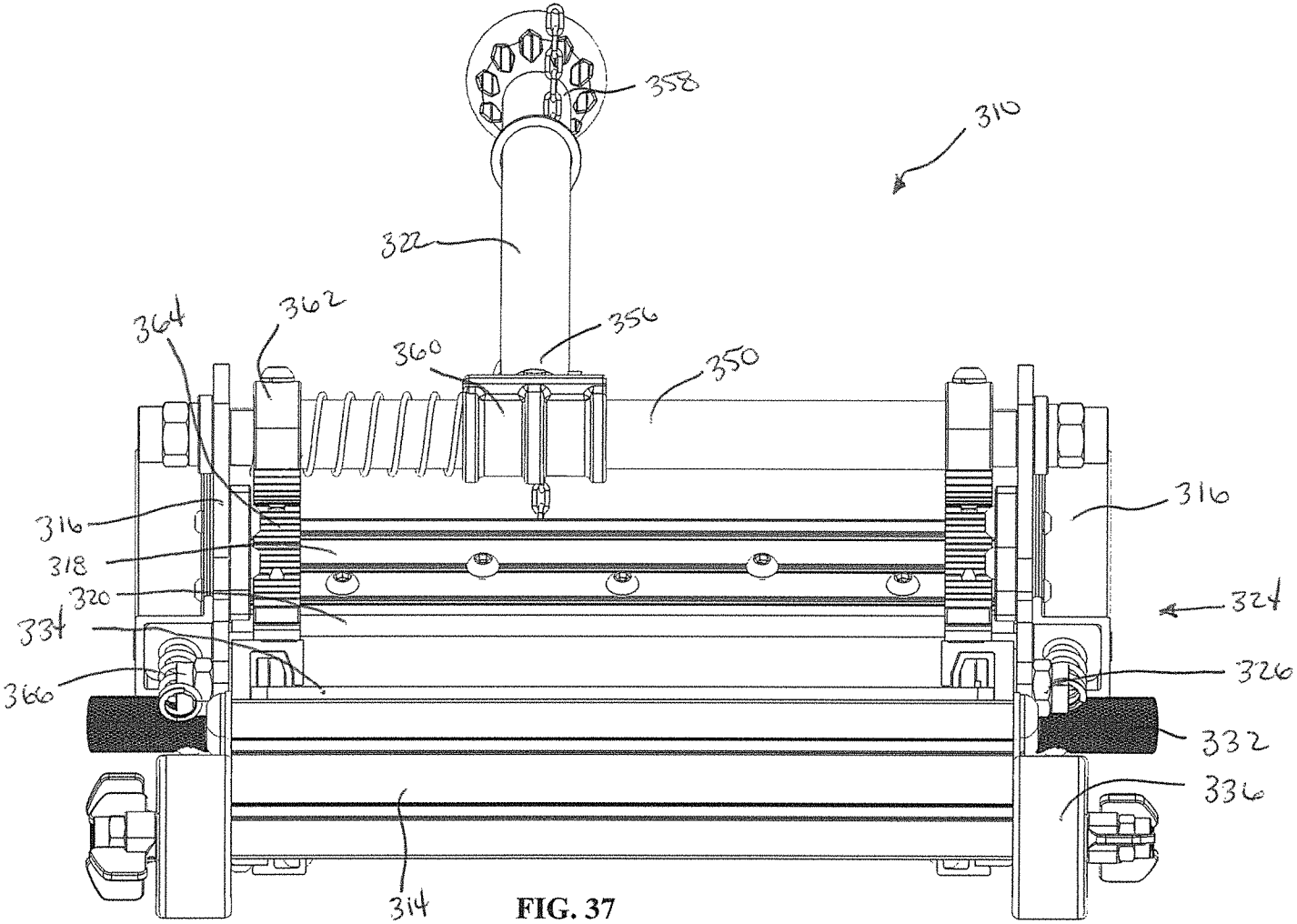
FIG. 37 shows a rear view of the cutting tool of FIG. 34.

As best shown in FIG. 37, the handle axle 350 further includes a gear 362 which engages with a rack 364 positioned on the blade holder 318. In operation, the cutting tool 310 of this invention starts in the starting position with the blade 320 spaced from the base 314. In the starting position, the material to be cut is placed onto the support surface 326 and through the opening formed between the blade 318 and the base 314. To cut the material, the handle 322 is lowered, rotating the gear 362 positioned on the handle axle 350. Teeth of the rotating gear 362 engage with teeth on the rack 364 causing the blade holder 318 to move downward through the material until the blade 320 contacts the blade stop of the base 314, the final cutting position, thereby severing the material. The resulting cut is optimally free of splinters and a resulting cut end of the material is otherwise clean and straight.

While in the foregoing specification this invention has been described in relation to certain preferred embodiments thereof, and many details have been set forth for purpose of illustration, it will be apparent to those skilled in the art that the material cutter is susceptible to additional embodiments and that certain of the details described herein can be varied considerably without departing from the basic principles of the invention.

What is claimed is:

1. A cutting tool for flexible material comprising:

a base including a support surface;

a pair of risers rotably connected to the base and positioned at a center of the base and the support surface, a blade holder including a blade, the blade holder positioned between the pair of risers, and wherein the pair of risers may be set at one of a plurality of angles to position the blade holder at an angular position;

a handle axle positioned between the pair of risers, the handle axle including a gear in contact with a rack on the blade holder and a handle for rotating the handle axle;

a pair of latches with a dual-action latch mechanism for engaging and disengaging both risers, the dual-action latch mechanism connecting the pair of latches with a pair of latch connectors, a pair of gears, and a bracket, wherein movement of one of the pair of latches moves a corresponding latch connector rotating the pair of gears mounted on the bracket and moving an other of the pair of the latches;

wherein the blade holder and the blade are movable between a starting position and a final cutting position by moving the handle; and wherein when cutting an acute angle the blade is positioned at a first angle to the base and wherein, due to properties of the flexible material, a sheet of flexible material is cut at a second angle, wherein the first angle is greater than the second angle.

2. The cutting tool of claim 1, wherein the first angle comprises an angle ranging from 46° to 52° and the second angle comprises 45°.

3. The cutting tool of claim 1, wherein the first angle comprises 50° and the second angle comprises 45°.

4. The cutting tool of claim 1, wherein the first angle comprises an angle ranging from 23° to 27° and the second angle comprises 22.5°.

5. The cutting tool of claim 1, wherein each of the pair of risers include a blade holder guide slot and wherein a portion of the blade holder extends through each of the blade holder guide slots to maintain the blade holder in a straight path as the blade moves from the starting position to the final cutting position.

6. A cutting tool for flexible material comprising:

a base including a support surface, the base having a length;

a pair of risers rotatably connected to the base in proximity to a center of the length, wherein each of the pair of risers include a plurality of slots;

a blade holder including a blade, the blade holder positioned between the pair of risers, and wherein the blade holder and the blade are movable between a starting position and a final cutting position;

a pair of latches movably connected to the base with a dual-action latch mechanism for engaging and disengaging the plurality of slots on both risers, the dual-action latch mechanism connecting the pair of latches with a pair of latch connectors, a pair of gears, and a bracket, wherein movement of one of the pair of latches moves a corresponding latch connector rotating the pair of gears mounted on the bracket and moving an other of the pair of the latches;

wherein the risers are positionable at a plurality of angular positions to align the blade at an angle relative to the base; and wherein when cutting an acute angle the blade is positioned at a first angle to the base and wherein, due to properties of the flexible material, a sheet of flexible material is cut at a second angle, wherein the first angle is greater than the second angle.

7. The cutting tool of claim 6, wherein the first angle comprises an angle ranging from 46° to 52° and the second angle comprises 45°.

8. The cutting tool of claim 6, wherein the first angle comprises 50° and the second angle comprises 45°.

9. The cutting tool of claim 6, wherein the first angle comprises an angle ranging from 23° to 27° and the second angle comprises 22.5°.

10. The cutting tool of claim 6, wherein each of the pair of risers include a blade holder guide slot and wherein a portion of the blade holder extends through each of the blade holder guide slots to maintain the blade holder in a straight path as the blade moves from the starting position to the final cutting position.

11. A cutting tool for flexible material comprising:

a base including a support surface, the base having a length;

a pair of risers rotatably connected to the base in proximity to a center of the length;

a blade holder including a blade, the blade holder positioned between the pair of risers;

a handle and a handle axle, the handle axle rotatably connected to the pair of risers, wherein the handle axle engages with the blade holder to move the blade holder and the blade between a starting position and a final cutting position by rotating the handle axle;

a pair of latches with a dual-action latch mechanism for engaging and disengaging the pair of risers, the dual-action latch mechanism connecting the pair of latches with a pair of latch connectors, a pair of gears, and a bracket, wherein movement of one of the pair of latches moves a corresponding latch connector rotating the pair of gears mounted on the bracket and moving an other of the pair of the latches; and wherein the risers can be set to a plurality of angular positions to align the blade at an angle relative to the base, wherein the blade is positioned at a first angle to the base and wherein, due to properties of the flexible material, a sheet of flexible material is cut at a second angle, wherein the first angle is greater than the second angle.

12. The cutting tool of claim 11, wherein the first angle comprises an angle ranging from 46° to 52° and the second angle comprises 45°.

13. The cutting tool of claim 11, wherein the first angle comprises an angle ranging from 23° to 27° and the second angle comprises 22.5°.

* * * * *